US008720594B2

(12) United States Patent
Sato et al.

(10) Patent No.: US 8,720,594 B2
(45) Date of Patent: May 13, 2014

(54) BEACH CLEANER

(75) Inventors: Yoshiyuki Sato, Wako (JP); Tatsuo Masuda, Wako (JP); Yasuji Hashimoto, Wako (JP); Kosuke Asao, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 0 days.

(21) Appl. No.: 13/574,173

(22) PCT Filed: Jan. 26, 2010

(86) PCT No.: PCT/JP2010/000433
§ 371 (c)(1),
(2), (4) Date: Jul. 19, 2012

(87) PCT Pub. No.: WO2011/092731
PCT Pub. Date: Aug. 4, 2011

(65) Prior Publication Data

US 2012/0285711 A1 Nov. 15, 2012

(51) Int. Cl.
*A01D 15/00* (2006.01)

(52) U.S. Cl.
USPC ..... 171/135

(58) Field of Classification Search
USPC ..... 171/1, 63, 111, 135
See application file for complete search history.

(56) References Cited

U.S. PATENT DOCUMENTS 625,669 A * 5/1899 Gorr ..... 56/200
2,706,877 A * 4/1955 Caldwell ..... 171/63
6,540,030 B2 * 4/2003 Ohzeki et al. ..... 171/1
6,568,482 B2 * 5/2003 Ohzeki et al. ..... 171/111
6,899,185 B2 5/2005 Yagisawa et al.
7,896,094 B2 * 3/2011 Arai et al. ..... 171/63
2004/0050559 A1 3/2004 Ohzeki et al.

FOREIGN PATENT DOCUMENTS

JP 11-172647 A 6/1999
JP 2002-178824 A 6/2002
JP 2002-356827 A 12/2002

(Continued)

OTHER PUBLICATIONS

Notice of Transmittal of Translation of the International Preliminary Report on the Patentability (Form PCT/IB/338) of International Patent Application No. PCT/JP2010/000433, dated Aug. 30, 2012, with Forms PCT/IB/373 and PCT/ISA/237.

(Continued)

*Primary Examiner* — Thomas B Will
*Assistant Examiner* — Joel F. Mitchell
(74) *Attorney, Agent, or Firm* — Westerman, Hattori, Daniels & Adrian, LLP

(57) ABSTRACT

A beach cleaner has a frame formed by a longitudinal member and a lateral member, a ski member that is secured to a front portion of the frame and grounded to a sand surface GL, a trailing target portion that is trailed by a trailing vehicle, a separator that is provided at a front lower portion of the frame and scrapes up trash from a sand area while separating the trash from sand, a trash withdrawing member that is provided to the frame at a rear side of the separator to collect the trash scraped up by the separator onto a mesh member, and a wheel at a rear side of the frame. The trash withdrawing member has a fixed withdrawing body that is located at a front end portion and fixed to the frame, and a swing withdrawing body.

7 Claims, 14 Drawing Sheets

(56) References Cited

FOREIGN PATENT DOCUMENTS

| | | | |
|---|---|---|---|
| JP | 3090540 | U | 12/2002 |
| JP | 2003-041547 | A | 2/2003 |
| JP | 2008-025209 | A | 2/2008 |

OTHER PUBLICATIONS

International Search Report of PCT/JP2010/000433, mailing date of May 18, 2010.

* cited by examiner

BEACH CLEANER

TECHNICAL FIELD

The present invention relates to a beach cleaner for efficiently collecting various kinds of trash scattered on a sandy beach such as a bathing beach or the like.

BACKGROUND ART

Various kinds of trash such as fragments of fishnets, ropes, vinyl strings, paper waste, blocs of wood, empty cans, bottles, PET bottles and caps thereof, cigarette butts, etc. are scattered in a sandy beach such as a bathing beach or the like. As a beach cleaner for collecting these kinds of trash is known a beach cleaner in which a frame is constructed by plural longitudinal members extending in a traveling direction and plural lateral members which extend in a width direction and are substantially perpendicular to the longitudinal members, ski members are arranged at the four corner portions of the frame concerned so as to come into contact with the sandy soil, a scraper is secured to the front portion of the frame, a trash withdrawing member constructed by a net member to a box-shaped frame which is opened forwardly and upwardly is provided to the rear portion of the frame, and the frame is towed by a towing vehicle to run on the sand soil under the state that the scraper bites into the sand soil, whereby relatively small trash can be scraped up together with sand and collected on the net member (for example, see Patent Document 1).

PRIOR ART DOCUMENT

Patent Document

Patent Document 1: JP-A-2002-356827

SUMMARY OF THE INVENTION

Problem to be Solved by the Invention

However, in the beach cleaner of the conventional construction, the frame is connected to the ground surface through a ski member, and thus there is a case where vibration applied to the trash withdrawing member is little and sand scraped onto a mesh member is stocked on the mesh member without being screened out. In such a case, a worker meanders a trailing vehicle or arbitrarily stops the trailing vehicle to remove the sand stocked in the trash withdrawing member in order to screen out the sand. Furthermore, when the sand is screened out by meandering the trailing vehicle or the like, pebbles or the like roll in connection with swinging, and thus trash which has been withdrawn with effort drops out.

Therefore, an object of the present invention is to provide a beach cleaner that can excellently screen out sand scraped out by a trash withdrawing member.

Means of Solving the Problem

A beach cleaner having a frame formed by a longitudinal member and a lateral member, a ski member that is secured to a front portion of the frame and grounded to a sand surface, a trailing target portion that is trailed by a trailing vehicle, a separator that is provided at a front lower portion of the frame and scrapes up trash from a sand area while separating the trash from sand, a trash withdrawing member that is provided to the frame at a rear side of the separator to collect the trash scraped up by the separator onto a mesh member, and a wheel at a rear side of the frame, is characterized in that the trash withdrawing member comprises a fixed withdrawing body that is located at a front end portion and fixed to the frame so as to be higher by one step, and a swing withdrawing body that is continuous with a rear portion of the fixed withdrawing body and supported so that a front end thereof is swingable at a lower position than the fixed withdrawing body to separate trash and sand from each other.

According to the above construction, the vibration caused by swinging is applied to the swing withdrawing body of the trash withdrawing member, and thus the sand invading onto the mesh member can be excellently screened out. The swing withdrawing body is swung at a lower position than the fixed withdrawing body, and thus even when trash (particularly, pebbles or the like) scraped up by the trash withdrawing body moves to the front end portion of the trash withdrawing member, the trash is intercepted by the fixed withdrawing body, and thus no trash drops out from the trash withdrawing body.

The swing withdrawing body may be freely swingably supported on the frame through a support shaft located at the fixed side.

According to the above construction, the lowermost portion of the swing withdrawing body is located at the fixed withdrawing body side, and thus trash such as pebbles or the like is effectively captured at the step portion formed between the swing withdrawing body and the fixed withdrawing body. Furthermore, the swing width of the neighborhood of the support shaft is small, and thus dropout of pebbles or the like due to popping caused by the swing can be prevented.

The swing withdrawing body may be freely swingably supported on the frame through a support shaft located at a rear side of a center portion in a front and rear direction.

According to the above construction, the front end portion of the swing withdrawing body is greatly swung, and thus pebbles or the like gather together at the rear end portion having a little swing width and thus can be prevented from dropping out.

A rear end edge of the fixed withdrawing body downwardly may hang, and a front end edge of the swing withdrawing body may be located inside the rear end edge and upwardly folded back to form a fold-back portion.

According to the above construction, the engaging structure can be established with keeping the step portion formed between the swing withdrawing body and the fixed withdrawing body, whereby the dropout of pebbles or the like to the front side can be prevented, and sandy beads invading into the engaging portion can be pulverized by the engagement.

The swing withdrawing body may be held by a sub frame, and the sub frame is freely swingably supported on the frame through the support shaft.

According to the above construction, the swing withdrawing body has the sub frame, so that the structure of the swing withdrawing body is firm, and the vibration based on the swing can be greatly transmitted to the swing withdrawing body.

The side wall portions at both the sides of the trash withdrawing member may be configured to be divided into front end side wall portions at the fixed side and rear end side wall portions at the swing side.

According to the above construction, one side is the fixed structure while the other side is the swing structure, and the side walls at the boundary between these structures are divided side walls. Therefore, side walls can be provided to the respective walls.

The front end edges of the front end side wall portions may be configured to spread frontwards, and the rear end side wall portions may be arranged to be overlapped with outsides of the rear end edges of the front end side wall portions.

According to the above construction, the side walls of the respective structures are overlapped with each other at the boundary portion thereof to establish the double fitting structure. Therefore, the sand is hard to invade into the fitting portion.

Effect of the Invention

According to the present invention, the vibration caused by swinging is applied to the swing withdrawing body of the trash withdrawing member, and thus the sand invading onto the mesh member can be excellently screened out. The swing withdrawing body is swung at a lower position than the fixed withdrawing body, and thus even when trash scraped up by the trash withdrawing body moves to the front end portion of the trash withdrawing member, the trash is intercepted by the fixed withdrawing body, and thus no trash drops out from the trash withdrawing body.

When the swing withdrawing body is freely swingably supported on the frame through a support shaft located at the fixed side, the lowermost portion of the swing withdrawing body is located at the fixed withdrawing body side, and thus trash such as pebbles or the like is effectively captured at the step portion formed between the swing withdrawing body and the fixed withdrawing body. Furthermore, the swing width of the neighborhood of the support shaft is small, and thus dropout of pebbles or the like due to popping caused by the swing can be prevented.

When the swing withdrawing body is freely swingably supported on the frame through a support shaft located at a rear side of a center portion in a front and rear direction, the front end portion of the swing withdrawing body is greatly swung, and thus pebbles or the like gather together at the rear end portion having a little swing width and thus can be prevented from dropping out.

When a rear end edge of the fixed withdrawing body downwardly hangs and a front end edge of the swing withdrawing body is located inside the rear end edge and upwardly folded back to form a fold-back portion, the engaging structure can be established with keeping the step portion formed between the swing withdrawing body and the fixed withdrawing body, whereby the dropout of pebbles or the like to the front side can be prevented, and sandy beads invading into the engaging portion can be pulverized by the engagement.

When the swing withdrawing body is held by a sub frame, and the sub frame is freely swingably supported on the frame through the support shaft, the swing withdrawing body has the sub frame, so that the structure of the swing withdrawing body is firm, and the vibration based on the swing can be greatly transmitted to the swing withdrawing body.

When the side wall portions at both the sides of the trash withdrawing member are configured to be divided into front end side wall portions at the fixed side and rear end side wall portions at the swing side, one side is the fixed structure while the other side is the swing structure, and the side walls at the boundary between these structures are divided side walls. Therefore, side walls can be provided to the respective walls. Furthermore, when the front end edges of the front end side wall portions are configured to spread frontwards, and the rear end side wall portions may be arranged to be overlapped with outsides of the rear end edges of the front end side wall portion, the side walls of the respective structures are overlapped with each other at the boundary portion thereof to establish the double fitting structure. Therefore, the sand is hard to invade into the fitting portion.

MODES FOR CARRYING OUT THE INVENTION

Preferred Embodiments according to the present invention will be described hereunder with reference to the drawings.

Figure 1:
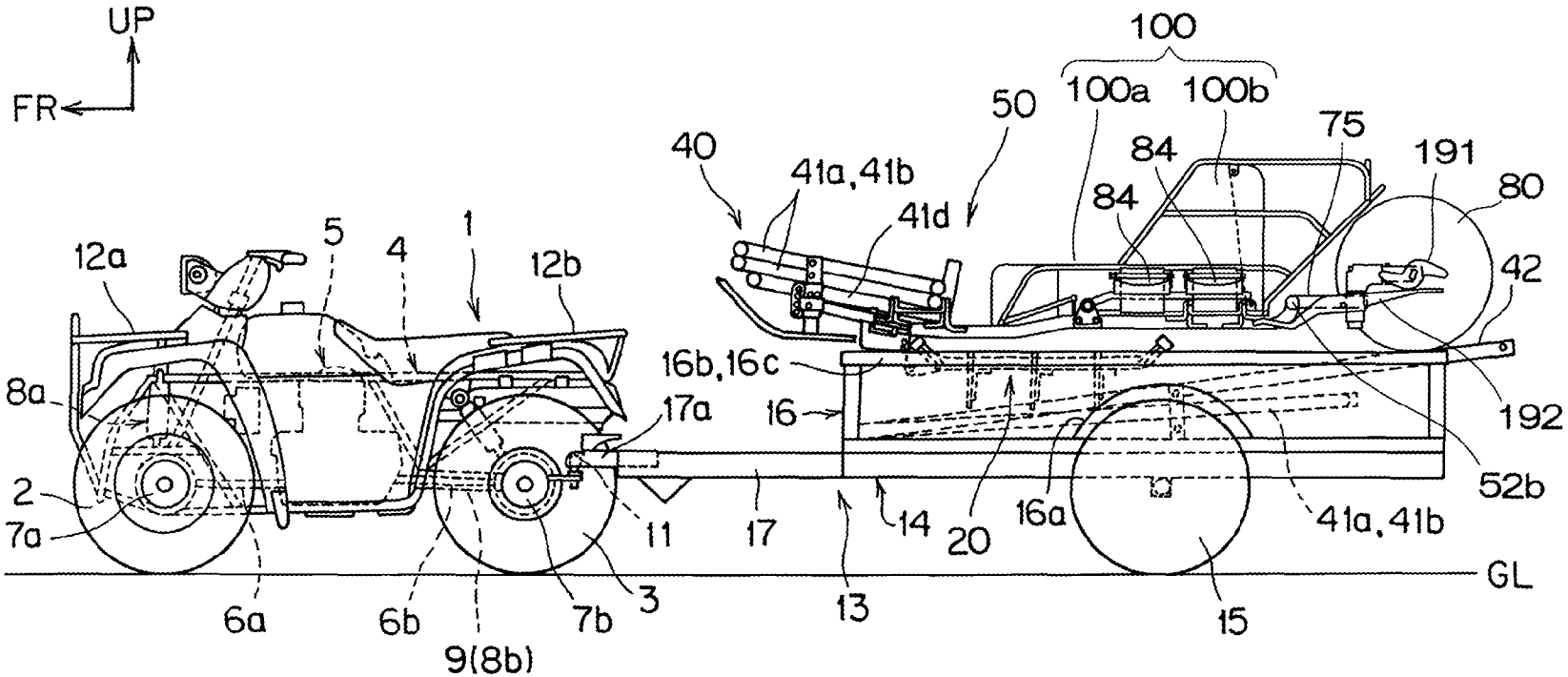
[FIG. 1] is a left side view when a beach cleaner according to the present invention, etc. are transported while mounted in a trailer.

FIG. 1 is a side view when a beach cleaner according to an embodiment, etc. are transported while mounted in a trailer.

A vehicle 1 shown in FIG. 1 is constructed as a so-called ATV (All Terrain Vehicle) having right and left front wheels 2 and rear wheels 3 as low-pressure balloon tires which are mounted at the front and rear sides of a compact and light vehicle body thereof and are relatively large in diameter, the minimum ground clearance thereof being set to be high, thereby enhancing running-through performance on irregular ground mainly. The vehicle body frame 4 of the vehicle 1 is configured to have a box-shaped structure which is long in the front-and-rear direction at the center portion in the vehicle width direction, and an engine 5 as a motor for the vehicle 1 is mounted substantially at the center portion of the vehicle frame 4.

The engine 5 is a water-cooled type single cylinder engine, for example, and outputs rotational power of a crank shaft to front and rear propeller shafts 6*a* and 6*b* through a gear engaging type transmission. The rotational power output to each of the front and rear propeller shafts 6*a* and 6*b* is output to the right and left front wheels 2 or rear wheels 3 through front and rear deceleration devices 7*a*, 7*b*.

Here, the vehicle 1 is a so-called semiautomatic vehicle in which the gear ratio of the transmission can be changed by an electrical operation, and thus the gear ratio can be changed, for example through a centrifugal clutch, by only an operation of a change button or the like without performing any clutch operation. The vehicle 1 as described above is more suitable for running under a large running load and running at a fixed speed as compared with a vehicle having a belt type transmission.

The vehicle 1 is not limited to the semiautomatic vehicle, and it may be an automatic transmission vehicle in which the gear ratio is automatically changed, for example.

The right and left wheels 2 are suspended to the front portion of the vehicle body frame 4 through an independent suspension type front suspension 8*a*, and the right and left rear wheels 3 are suspended to the rear portion of the vehicle body frame 4 through a swing arm type rear suspension 8*b*, for example. A trailer hitch 11 for towing the trailer 13 is provided to the rear end portion of a swing arm 9 of the rear suspension 8*b*. In the figures, reference numeral 12*a* represents a front carrier supported on the front portion of the vehicle body frame 4, and reference numeral 12*b* represents a rear carrier supported on the rear portion of the vehicle body frame 4.

The vehicle 1 can tow the trailer 13, and first and second beach cleaners 20, 50 and a trash withdrawing station 40 described later are mounted in the trailer 13.

The trailer 13 has a pair of right and left wheels 15 at both the sides of the lower portion of the vehicle body frame 14 thereof, a box-shaped loading portion 16 which is upwardly opened, shallow in the vertical direction and provided above the vehicle body frame 14, and a towing arm 17 which is provided so as to extend forwardly from the lower side of the front portion of the vehicle body frame 14. A hitch coupler 17*a* corresponding to the trailer hitch 11 is provided to the front end portion of the towing arm 17. The vehicle body frame 14 is designed to be square-shaped in top view, and the loading portion 16 is provided to be substantially overlapped with the vehicle body frame 14 in top view. The loading portion 16 is constructed by mounting plate members on a frame-shaped frame to form front, back, right and left wall portions and a bottom wall portion. Wheel houses 16*a* corresponding to the right and left wheels 15 are formed at both the right and left sides of the bottom wall portion of the loading portion 16 so as to be swollen upwardly.

Parts of respective divided bodies constituting the trash withdrawing station 40 are mounted in the loading portion 16, and the first and second beach cleaners 20, 50 and parts of the respective divided bodies are mounted on the loading portion 16. The trailer 13 is towed by the vehicle 1 under the loading state as described above, whereby the respective beach cleaners 20, 50 and the trash withdrawing station 40 can be transported to a predetermined working place. In the following description, sites forming the right and left upper edge portions of the loading portion 16 of the frame concerned are right and left side portions 16*b*, 16*c*, respectively.

Figure 2:
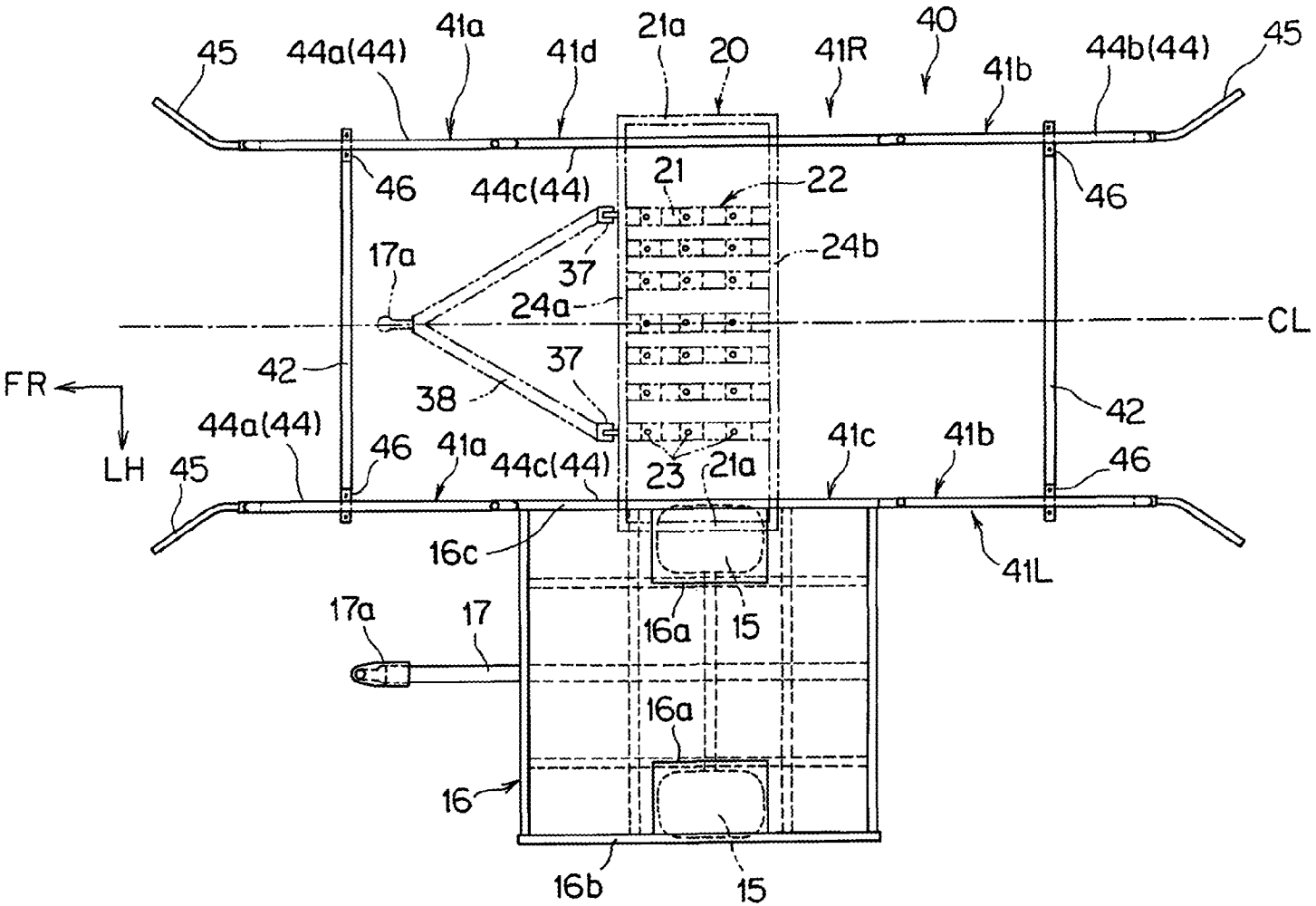
[FIG. 2] is a plan view showing a state that a first beach cleaner is lifted up to a trash withdrawing station.

The respective beach cleaners 20, 50 and the trash withdrawing station 40 shown in FIG. 1 are illustrated as being under a loading state on the trailer 13, and the respective beach cleaners 20, 50 and the trash withdrawing station 40 shown in FIG. 2 and subsequent figures are illustrated as being under a use state on the sand soil unless particularly described. In the following description as shown in FIG. 1, the state that both the wheels 15 of the trailer 13 come into contact with the ground and the loading portion 16 is kept in a substantially horizontal position at a predetermined height is referred to as "towing state of trailer 13" in some cases.

In the figures, a line GL represents the land surface (sand surface), a line CL (FIG. 2) represents the center with respect to the right-and-left direction of the vehicle 1, the respective beach cleaners 20, 50 and the trash withdrawing station 40 through which the beach cleaners 20, 50 are passed (hereinafter referred to as "vehicle, etc."), an arrow FR represents the front side in the running direction (front-and-rear direction) of the vehicle, etc., an arrow UP represents the upward direction in the up-and-down direction of the vehicle, etc., and an arrow LH (FIG. 2, FIG. 5 and FIG. 7) represents a leftward direction in the right-and-left direction of the vehicle, etc.

As shown in FIG. 1, when the vehicle 1 tows the trailer 13 and the trailer 13 reaches a beach to be cleaned, the respective mounted beach cleaners 20, 50 and trash withdrawing station 40 are unladed, and the trash withdrawing station 40 is first assembled as shown in FIG. 2 and set up at a predetermined place on the sandy beach.

Next, the first beach cleaner 20 withdraws various kinds of relatively large trash (ropes, nets, driftwood, etc.) scattered on a sand area (sandy beach) of seashore or the like while the first beach cleaner 20 is towed by the vehicle 1 and runs on the sand area, and the trash is withdrawn in the trash withdrawing station 40 set up at the predetermined place on the sand area. At this time, the vehicle 1 and the beach cleaner 20 goes into the trash withdrawing station 4 while the center in the right-and-left direction of the vehicle 1 is aligned with a line CL as shown in FIG. 2. At this time, the beach cleaner 20 towed by the vehicle 1 runs onto the trash withdrawing station 40 at a low position thereof in connection with the travel of the vehicle 1 as indicated by a broken line of FIG. 3, and it is gradually lifted up along an upward slope. Finally, the beach cleaner 20 reaches a high horizontal position, and bulky trash withdrawn by the beach cleaner 20 is dropped just below onto the sand at the horizontal position and withdrawn as described later.

Subsequently, the second beach cleaner 50 withdraws various relatively small trash (beverage containers, wastepaper, cigarette butts, etc.) scattered on the sand area (sand beach) of seashore or the like into a trash withdrawing member 100 (see FIG. 4) described later of the second beach cleaner 50 while the second beach cleaner 50 is towed by the vehicle 1 and runs on the sand area. The second beach cleaner 50 is lifted up to a high horizontal position of the trash withdrawing station 40 according to the same procedure as described above (see FIG. 7). At this horizontal position, one end of the trash withdrawing member 100 is tipped up laterally with the other end of the trash withdrawing member 100 as a base point, whereby the relatively small trash is withdrawn into a loading portion 16 of the trailer 13 which is adjacently located at the left side of the trash withdrawing station 40.

Each of the beach cleaners 20, 50 and the trash withdrawing station 40 is formed by suitably assembling plural kinds of steel products such as stainless or the like by using joint means such as welding or the like. Each of the beach cleaners 20, 50 may be towed by the tractor.

Figure 3:
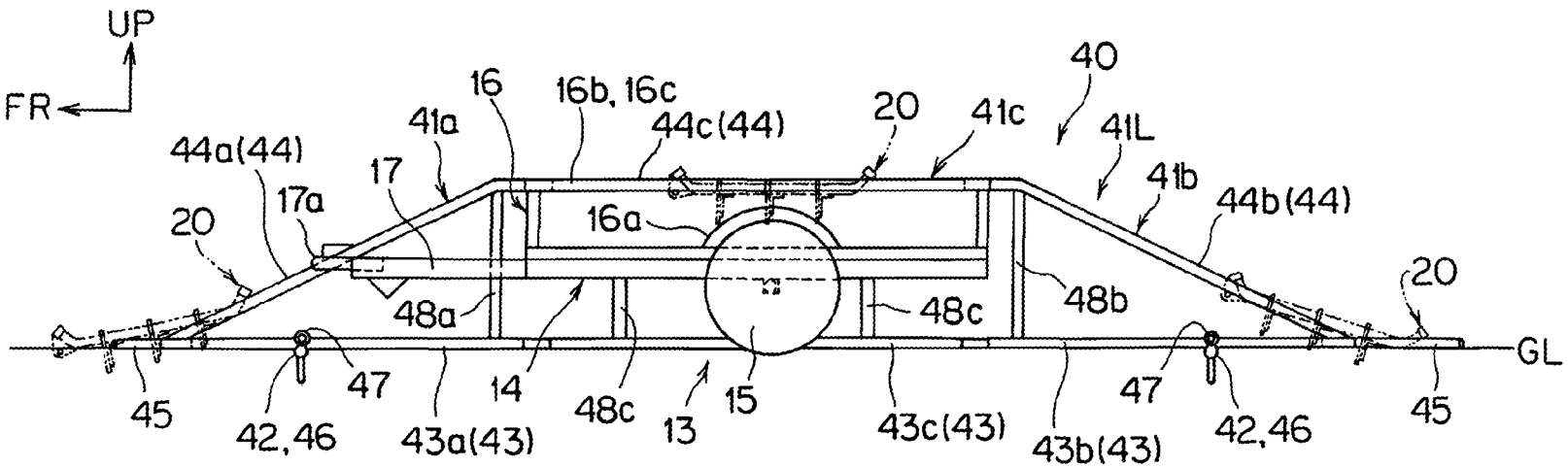
[FIG. 3] is a left side view showing a state that the first beach cleaner is lifted up to the trash withdrawing station.

FIG. 2 is a plan view showing a state that the first beach cleaner 20 is lifted up to the trash withdrawing station 40, and FIG. 3 is a left side view showing a state that the first beach cleaner 20 is lifted up to the trash withdrawing station 40.

As indicated by a broken line in FIG. 2, the first beach cleaner 20 is constructed by arranging plural (for example, fifteen) longitudinal members 21 extending along the running direction at even intervals in the width direction (right-and-left direction) to form a drainboard type frame 22, and detachably securing plural downwardly-projecting sand pins 23 to the respective longitudinal members 21. The first beach cleaner 20 has a symmetrical structure with respect to the right-and-left direction.

The longitudinal member 21 is constructed by disposing a circular steel pipe (rectangular steel pipe) along the front-and-rear direction and obliquely bending the front and rear end portions thereof to the upper front or upper rear side.

Front and rear lateral members 24*a*, 24*b* extend to right and left outside positions which are further outside the outermost longitudinal members 21, and side longitudinal members 21*a* which are bent like the longitudinal members 21 bridges the end portions of the front and rear lateral members 24*a*, 24*b* at the right and left sides.

The frame 22 constructed by these members is a laterally elongated rectangular shape in top view, and the right-and-left width thereof is set to be larger than the right-and-left width of the vehicle 1 (see FIG. 1) and the right-and-left width between right and left side structures 41R and 41L of the trash withdrawing station 40 described later. When the first beach cleaner 20 towed by the vehicle 1 gets between the right and left side structures 41R and 41L, both the right and left side portions of the frame 22 get on the right and left side structures 41R, 41L, whereby the first beach cleaner 20 is lifted up to a predetermined height. The right-and-left width between the right and left side structures 41R and 41L is set to be larger than the right-and-left width of the vehicle 1, and thus the vehicle 1 can pass through the gap between the right and left side structures 41R and 41L.

The first beach cleaner 20 as described above runs on the sand, whereby relatively large-size strewn trash (ropes, nets, wood offcuts, etc.) are hooked or entangled to the respective sand pins 23 to be scooped up.

Towing portions 37 for towing the first beach cleaner 20 by the vehicle 1 are provided to the front portions of third longitudinal members 21 from the right and left outer ends of the frame 22, for example. The towing portions 37 are formed of thick plates extending perpendicularly to the right-and-left directions, and joint holes (not shown) are formed at the front end portions thereof. One ends of a towing rod 38 which is joined to the trailer hitch 11 of the vehicle 1 at the other end thereof are joined to the joint holes, and the first beach cleaner 20 is towed by the vehicle 1 through the towing rod 38.

By providing plural joint holes in the up-and-down direction, the optimum towing position corresponding to biting of the first beach cleaner 20 into the sand or the like can be set in accordance with which one of the joint hole is fitted to the one end of the towing rod 38. Furthermore, the towing rod 38 extends from the other end thereof jointed to the trailer hitch 11 to the right and left towing portions 37 like V-shape or Y-shape in top view, and the other end of the towing rod 38 is provided with the hitch coupler 17*a* corresponding to the trailer hitch 11.

With respect to the trash withdrawing station 40, as shown in FIG. 3, when the first beach cleaner 20 is lifted up, each sand pin 23 is sufficiently separated from the sand surface, and also trash scraped and collected by the respective sand pins 23 can be dropped onto the sand, whereby the trash concerned can be collectively withdrawn.

As shown in FIGS. 2 and 3, the trash withdrawing station 40 is constructed by integrally joining the right and left side structures 41R and 41L through a pair of front and rear joint members 42, and are designed to be symmetrical with each other with respect to the front-and-rear direction and the right-and-left direction except for the structures of the intermediate portions in the front-and-rear direction of the side structures 41R and 41L.

Each of the right and left side structure 41R, 41L is constructed by disposing a guide member 44 formed of a circular steel pipe having a gentle mount-like shape in side view on a ground contact member 43 which is formed of a circular steel pipe and extends along the front-and-rear direction, for example, and integrally joining the front and rear end portions of these members 43 and 44 so that each of the right and left side structures 41R, 41L is designed in a trapezoidal shape in side view.

Foot members 45 which are sloped so as to outwardly extend in the right and left direction toward the front side or rear side in top view are detachably secured to the front and rear end portions of the right and left ground contact members 43. Each foot member 45 is grounded on the sand together with each ground contact member 43, whereby the trash withdrawing station 40 is stably installed while the ground contact area thereof is increased.

The joint members 42 are formed of circular steel pipes extending along the right-and-left direction, for example, and the end portions thereof are detachably fitted in joint pipes 46 provided at the lower portions of the front portions or rear portions of the ground contact members 43, whereby the right and left side structures 41R, 41L are integrally joined to each other. That is, the trash withdrawing station 40 is designed in a relatively large size. Therefore, it can be divided into plural divided parts (the right and left side structures 41R, 41L and the front and rear joint members 42), and further each of the right and left side structures 41R, 41L can be divided into three divided parts in the front-and-rear direction. Specifically, the left side structure 41L can be divided into a front divided part 41*a*, a left intermediate divided part 41*c* and a rear divided part 41*b*, and also the right side structure 41R can be divided into the front divided part 41*a*, a right intermediate divided part 41*d* and the rear divided part 41*b*.

The front and rear joint pipes 46 of the ground contact members 43 are formed of relatively short circular steel pipes extending along the right-and-left direction, and upper outer peripheries thereof are fitted and integrally jointed to cut-out portions formed at the lower portions of the ground contact members 43. That is, the joint pipes 46 project downwardly from the lower surfaces of the ground contact members 43, and bite into the sand to suppress movement of the trash withdrawing station 40 when the trash withdrawing station 40 is installed on the sand.

Fitting pins 47 penetrate through the joint members 42 and the joint pipes 46, and are further inserted into the sand by a predetermined amount. That is, the fitting pins 47 suppresses the movement of the trash withdrawing station 40 from a predetermined position under the installation state of the trash withdrawing station 40. The fitting pins 47 are detached and the joint members 42 are picked out of the joint pipes 46, whereby the trash withdrawing station 40 can be divided into the right and left side structures 41R and 41L and the front and rear joint members 42.

The front divided part 41*a* of each of the right and left side structures 41R and 41L mainly comprises a front slope portion 44*a* of the guide member 44, a front horizontal portion 43*a* of the ground contact member 43 which is located below the front slope portion 44*a*, and a front support member 48*a* which extends substantially vertically so as to bridge the rear end portions of the front slope portion 44*a* and front horizontal portion 43*a*. The rear divided part 41*b* mainly comprises a rear slope portion 44*b* of the guide member 44, a rear horizontal portion 43*b* of the ground contact member 43 which is located below the rear slope portion 44*b*, and a rear support member 48*b* which extends substantially vertically between the front end portions of the rear slope portion 44*b* and rear horizontal portion 43*b*. In this embodiment, the front and rear divided parts 41*a* and 41*b* have the same shape, and they may be arranged back to front.

The left intermediate divided part 41*c* in this embodiment is constructed by the trailer 13 under the towing state. Specifically, the right side portion 16*c* of the loading portion 16 of the trailer 13 under the towing state is a substantially horizontal single rod, and the right side portion 16*c* constitutes a substantially horizontal upper side portion 44*c* of the guide member 44. Furthermore, under the towing state of the trailer 13, the height of the right side portion 16*c* as the right upper edge portion of the loading portion 16 is set to be substantially equal to the height of the upper side portion 44*c* of the guide member 44 under the state that the trash withdrawing station 40 is installed on the sand (use state). The trailer 13 can self-stand through a support leg (not shown) under the towing state.

The rear end portion of the front slope portion 44*a* of the front divided part 41*a* is detachably secured to the front end portion of the right side portion 16*c*, and the front end portion of the rear slope portion 44*b* of the rear divided part 41*b* is detachably secured to the rear end portion of the right side portion 16*c*. The front and rear end portions of the right side portion 16*c* may be undetachably joined to the front and rear end portions of the front and rear slope portions 44*a* and 44*b* by conducting a predetermined coming-off preventing treatment, and also the right side portion 16*c* and the front and rear slope portions 44*a*, 44*b* can be divided from one another by releasing the coming-off preventing treatment.

As described above, a part of the left side structure 41L is constructed by the right side portion 16*c* of the trailer 13, whereby the trailer 13 is located just at the left side of the trash withdrawing station 40 so as to be adjacent to the trash withdrawing station 40 under the installation state of the trash withdrawing station 40.

The right intermediate divided part 41*d* mainly comprises a substantially horizontal upper side portion 44*c* of the guide member 44, an intermediate horizontal portion 43*c* of the ground contact member 43 which is located below the upper side portion 44*c*, substantially vertical plural (in this embodiment, a pair of) intermediate support members 48*c* between the upper side portion 44*c* and the intermediate horizontal portion 43*c*, and it is designed to be ladder-structured in side view. The rear end portion of the front slope portion 44*a* of the front divided part 41*a* is detachably secured to the front end portion of the upper side portion 44*c*, and the front end portion of the rear slope portion 44*b* of the rear divided part 41*b* is detachably secured to the rear end portion of the upper side portion 44*c*. The rear end portion of the front horizontal portion 43*a* of the front divided part 41*a* is detachably secured to the front end portion of the intermediate horizontal portion 43*c*, and the front end portion of the rear horizontal portion 43*b* of the rear divided part 41*b* is detachably secured to the rear end portion of the intermediate horizontal portion 43*c*.

The front and rear end portions of the upper side portion 44*c* and the front and rear end portions of the front and rear slope portions 44*a* and 44*b* are detachably joined to one another by executing a predetermined coming-off preventing treatment, and also the upper side portion 44*c* and the front and rear slope portions 44*a*, 44*b* can be divided by releasing the coming-off preventing treatment. Likewise, the front and rear end portions of the intermediate horizontal portion 43*c* and the front and rear end portions of the front and rear horizontal portions 43*a*, 43*b* are detachably joined to one another by executing a predetermined coming-off preventing treatment, and also they can be divided by releasing the predetermined coming-off preventing treatment. The member corresponding to the intermediate horizontal portion 43*c* may be provided to the left side structure 41L.

The substantially horizontal left side portion 16*b* of the loading portion 16 of the trailer 13 may be used as the upper side portion 44*c* of the guide member 44 as in the case of the right side portion 16*c*. The width in the right-and-left direction between the right and left side portions 16*b* and 16*c* is set to be substantially equal to the width in the right-and-left direction between the right and left side structures 41R and 41L, and the front end portion of the rear slope portion 44*b* of the rear divided part 41*b* is joined to each of the rear end portions of the right and left side portions 16*b* and 16*c* of the loading portion 16, whereby the same construction as the rear half portion under the installation state of the trash withdrawing station 40 can be reproduced.

According to this construction, when the trailer 13 reaches the beach to be cleaned, the trash withdrawing station 40 is first assembled, and the loading portion 16 of the trailer 13 is located to be adjacent to the trash withdrawing station 40. Under this condition, it is possible to horizontally move the first beach cleaner 20 (and the second beach cleaner 50) loaded on the loading portion 16 to the trash withdrawing station 40 side and unload them from that position along the upper side portions 44*c* and the rear slope portions 44*b* of the right and left guide members 44 onto the sand area. The inverse procedure makes it possible to lift up the first beach cleaner 20 (and the second beach cleaner 50) along the rear slope portions 44*b* and the upper side portions 44*c* of the right and left guide members 44 to the trash withdrawing station 40, horizontally move them from that position and lift up them onto the loading portion 16. The state that the rear divided parts 41*b* are joined to the right and left side portions 16*b* and 16*c* may be referred to as an unloading work state of the trailer 13.

Figure 4:
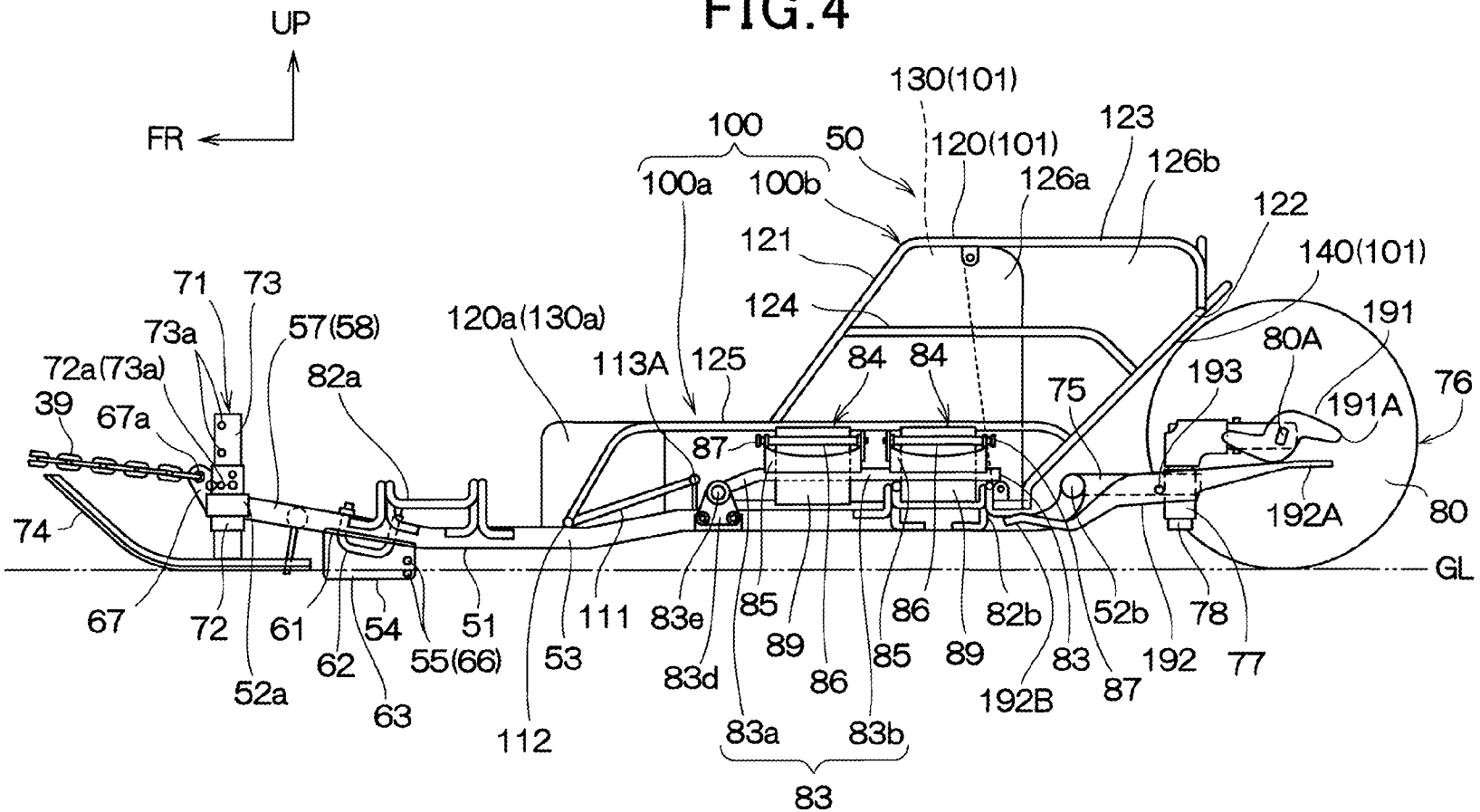
[FIG. 4] is a left side view showing a vehicle towing state of a second beach cleaner.
Figure 5:
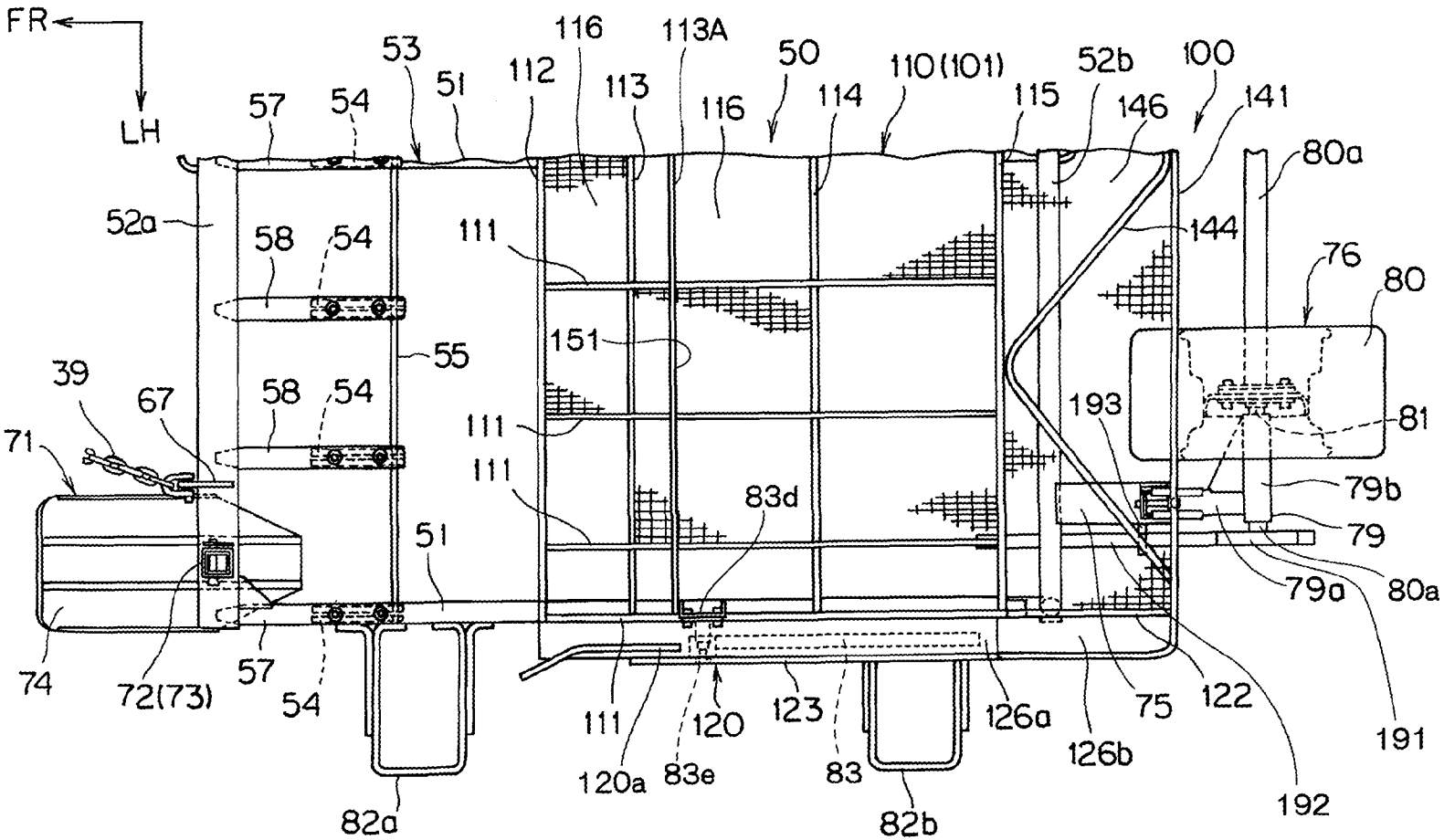
[FIG. 5] is a plan view showing a left half of the second beach cleaner.
Figure 6:
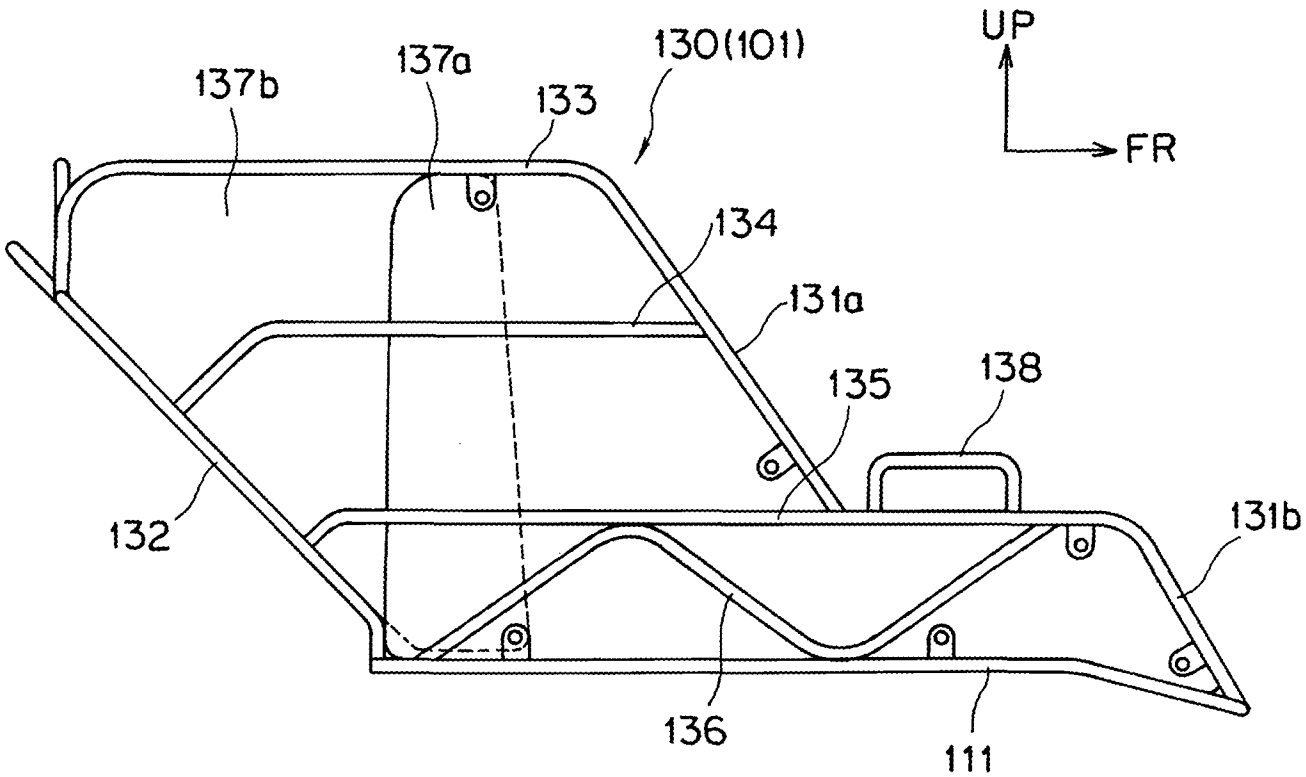
[FIG. 6] is a right side view showing a right side wall portion of the second beach cleaner.
Figure 7:
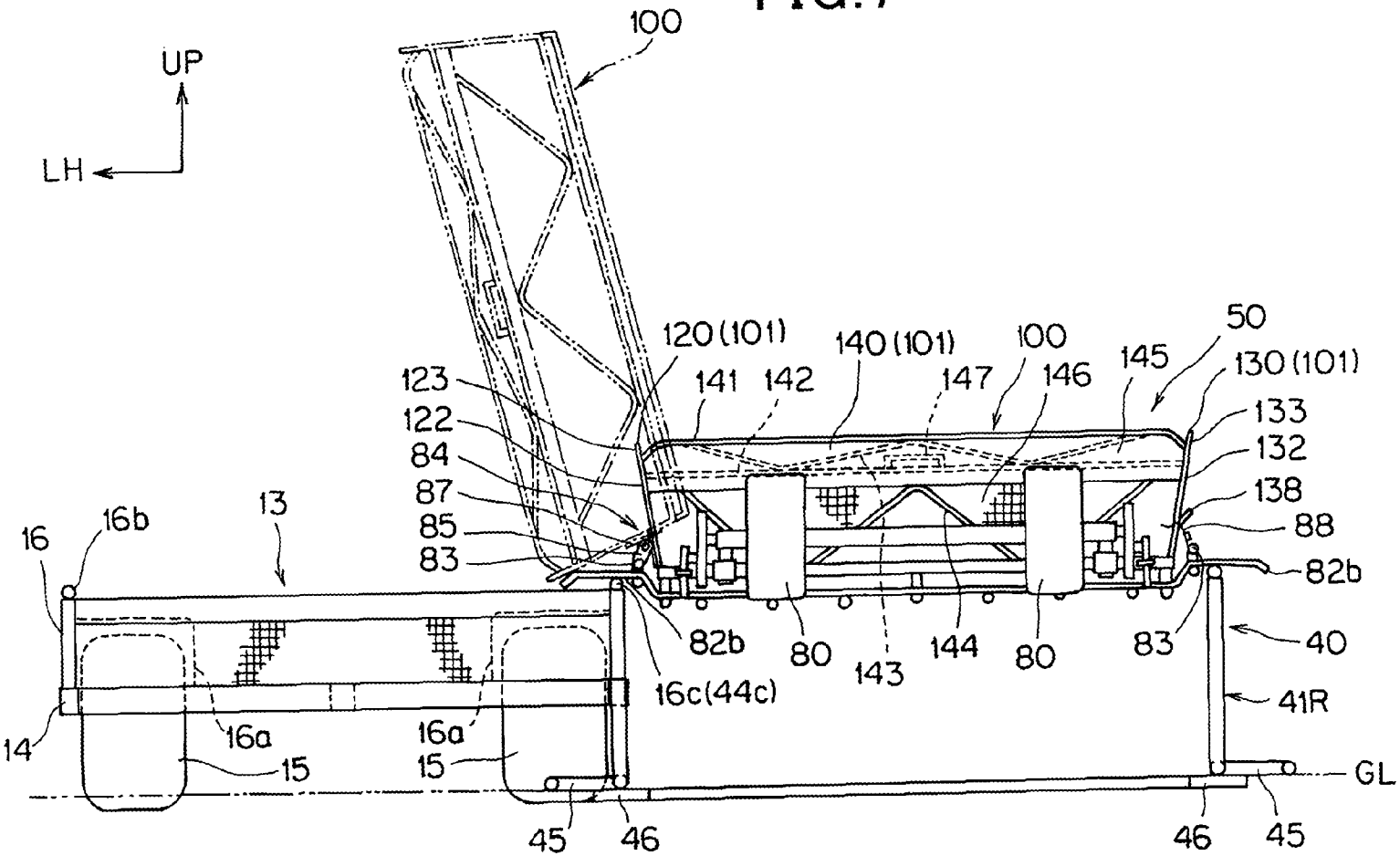
[FIG. 7] is a rear view showing a state that the second beach cleaner is lifted up to the trash withdrawing station.

FIG. 4 is a left side view showing a vehicle towing state of the second beach cleaner 50, and FIG. 5 is a plan view showing a left half of the second beach cleaner 50. FIG. 6 is a right side view showing the right side wall portion of the second beach cleaner 50. FIG. 7 is a rear view showing a state that the second beach cleaner 50 is lifted up to the trash withdrawing station 40.

As shown in FIGS. 4 and 5, the second beach cleaner 50 has a frame type frame 53 which mainly comprises plural (for example, three) longitudinal members 51 extending along the vehicle running direction and front and rear lateral members 52*a* and 52*b* extending in the width direction (right-and-left direction) substantially perpendicularly to the longitudinal members 51, keels 54 (separating devices) and a scraper 55 (separating device) described later which are provided to the front portion of the frame 53 concerned, and a trash withdrawing member 100 described later which is provided to the rear portion of the frame 53 concerned.

The longitudinal members 51 are constructed by arranging circular steel pipes along the front-and-rear direction and gently cranking the intermediate portions of the circular steel pipes in the front-and-rear direction in side view so that the rear portions thereof are located to be slightly higher than the front portions thereof. At the front portion of the longitudinal member 51, the center portion thereof in the front-and-rear direction is gently bent, and thus the front half portion of the front portion is provided to be slightly sloped to the front and upper side. The front half portion of the front portion of the longitudinal member 51 will be hereunder referred to as a front slope portion 57. The rear end portion of the longitudinal member 51 is provided to be curved to the upper side. The plural longitudinal members 51 are arranged in juxtaposition with one another in the right-and-left direction so as to be overlapped with one another in side view. The front ends of the longitudinal members 51 are butted and joined from the rear side to a front lateral member 52*a* formed of a rectangular steel pipe extending along the right-and-left direction, for example, and also the rear ends thereof are butted and joined from the lower side to a rear lateral member 52*b* formed of a circular steel pipe extending along the right-and-left direction, for example. The frame 53 which mainly comprises the respective longitudinal members 51 and the lateral members 52*a* and 52*b* is designed in a substantially square shape in top view. The width in the right-and-left direction of the frame 53 is set to be smaller than the width in the right-and-left direction between the right and left side structures 41R and 41L of the trash withdrawing station 40.

Plural (for example, two) scraper frames 58 which are sloped so as to be overlapped with the front slope portions 57 in side view are arranged in juxtaposition with one another in the right-and-left direction between the center longitudinal member 51 in the right-and-left direction and each of the longitudinal members 51 at both the right and left sides. The scraper frame 58 is formed of a circular steel pipe (or rectangular steel pipe) having the same diameter as the longitudinal member 51, the front end thereof is butted and joined from the rear side to the front lateral member 52*a*, and the rear end thereof is set as a free end which is not joined to any member.

The front slope portion 57 of each longitudinal member 51 and each scraper frame 58 are provided with a keel 54 and a scraper 55 as separating devices for separating sand and relatively small trash (drink containers, paper scraps, stub of cigarette, etc.) from the sand and scraping up them when the second beach cleaner 50 runs while being towed.

The keel 54 is detachably secured to the rear portion of the front slope portion 57 of the longitudinal member 51 and the rear portion of each scraper frame 58, and it has a plate member 61 which is curved so as to be fitted to the outer surface of the lower portion of the front slope portion 57 or the scraper frame 58, a U-shaped pin 62 which is designed in an U-shape so as to be opened upwardly in side view and penetrates through the plate member 61 at both the side portions thereof, and a keel body 63 which is designed in a planar shape so as to be substantially perpendicular to the right-and-left direction and extends from the lower end edge of the plate member 61 downwardly.

Plural scraper support holes 66 are formed at the rear end portion of the keel 54 (keel body 63), and the scraper 55 is inserted and supported in each scraper support hole 66. The scraper 55 is designed in a rod-like shape so as to extend along the right-and-left direction and be circular in cross-section, and it is supported by the keels 54 while penetrating through the upper and lower scraper support holes 66 so as to bridge the respective keels 54. The scraper 55 can be selectively supported in conformity with the condition of sand beach or trash, and plural scrapers 55 may be supported. Both end portions of the scraper 55 is subjected to the coming-off preventing treatment for preventing the scraper 55 from come off from each keel 54 by inserting a predetermined locking pin or the like. The cross-sectional shape of the scraper 55 is not limited to a circular shape, but it may be a semi-circular shape having an upper surface sloping to the lower front side, for example. The number of the scrapers 55 may be set to one or three or more, and they may be juxtaposed with one another not only in the up-and-down direction, but also in the right-and-left direction or obliquely.

Each keel 54 and the scraper 55 are set so as to sink into the sand by a proper amount, and when the second beach cleaner 50 runs under this state, each keel 54 scrapes and separates sand and trash, and also each scraper 55 scrapes up them, whereby the scraped up sand and trash are thrown into the trash withdrawing member 100 at the rear portion of the frame 53.

A towed portion (a portion to be towed) 67 through which the second beach cleaner 50 is towed by the vehicle 1 (see FIG. 1) is provided at the front side of a first scraper frame 58 from an outer end in the right-and-left direction of the frame 53, for example. The towed portion 67 is designed like a thick plate to be perpendicular to the right-and-left direction, and a joint hole 67*a* is formed in the towed portion 67. One end of a towing chain 39 which is joined to the trailer hitch 11 (see FIG. 1) of the vehicle 1 at the other end thereof is joined to the joint hole 67*a*, and the second beach cleaner 50 is towed by the vehicle 1 through the towing chain 39.

Furthermore, a front ski support pipe 72 for supporting a front ski leg 71 is provided to the front side of the scraper frame 58 at each outermost side in the right-and-left direction of the frame 53. The front ski support pipe 72 is formed of a rectangular steel pipe which vertically penetrates through a front lateral member 52*a*, and it can be inserted and supported in a leg member 7 which is also formed of a rectangular steel pipe in the front ski leg 71. The front ski leg 71 serves to set the ground height (the height from the surface of the sand) of the front portion of the second beach cleaner 50 to a predetermined height and also enhance sliding performance to the sand, and it comprises a front ski plate (ski member) 74 which is curved to the upper front side at the front portion thereof and has a predetermined width, and a leg member 73 which is provided on the front ski plate 74 so as to be erected from the front ski plate 74.

Right and left through holes 72*a* are formed in the front ski support pipe 72, and plural (for example, four) right and left through holes 73*a* corresponding to the right and left through holes 72*a* are vertically formed in the leg member 73. Any one of the right and left through holes 73*a* is overlapped with the right and left through holes 72*a* of the front ski support pipe 72 and a predetermined locking pin or the like is inserted into these holes, whereby the height of the front portion of the frame 53 with respect to the front ski leg 71 is determined and thus the ground height of the front portion of the second beach cleaner 50 is set to a predetermined height. That is, the ground height of the front portion of the second beach cleaner 50 can be adjusted in accordance with any one of the right and left through-holes 73*a* of the leg member 73 in which the locking pin or the like is inserted, whereby the sinking amount at which each keel 54 and the scraper 55 sink in the sand can be adjusted.

As shown in FIG. 4, rear legs 76 are supported at both sides of the rear portion of the rear lateral member 52*b*. The rear legs 76 comprise extension frames 75 extending from both the sides of the rear portion of the rear lateral member 52*b*, rear leg support pipes 77 penetrating vertically through the rear end portions of the extension frames 75, leg members 78 inserted through the rear leg support pipes 77, arm members 79 each of which has an arm 79*a* extending from the upper portion of the leg member 78 backwardly and an arm 79*b* (see FIG. 5) extending from the rear end portion of the arm 79*a* to the inside of the vehicle, and right and left wheels 80 whose centers are joined to each other through an axle 80*a*. The rear legs 76 serve to set the ground height (the height from the sand surface) of the rear portion of the second beach cleaner 50 to a predetermined height.

Two right and left through holes 77*a* are formed in the rear leg support pipe 77, and plural (for example, six) right and left through-holes 78*a* corresponding to the right and left through holes 77*a* are formed in the leg member 78 so as to be arranged in the height direction. Any one of the right and left through holes 78*a* is overlapped with the right and left through holes 77*a* of the rear leg support pipe 77 and a predetermined locking pin or the like is fitted in these through holes, whereby the height of the rear portion of the frame 53 with respect to the rear leg 76 is determined and thus the ground height of the rear portion of the second beach cleaner 50 is set to a predetermined height.

As described above, the securing height of the rear portion of the second beach cleaner 50 from the ground surface GL can be adjusted in accordance with any one of the right and left through holes 78*a* of the leg member 78 in which the locking pin or the like is fitted, and thus the sinking amount at which each keel 54 and the scraper 55 sink into the sand can be adjusted. Therefore, the second beach cleaner 50 can effectively remove trash by adjusting the sinking amount of each keel 54 and the scraper 55 in the sand in accordance with the condition of the sand, so that the burden imposed on a worker can be reduced.

As shown in FIG. 4, front and rear lift arms 82*a* and 82*b* are provided at the right and left outsides of the front and rear portions of the frame 53 so as to protrude from the ends of the right and left outsides outwardly in the right-and-left direction. Each of the lift arms 82*a* and 82*b* is designed in a frame-like shape so as to be laterally elongated square-shaped in top view, for example. The intermediate portion thereof in the right-and-left direction is formed to be substantially horizontal, the inside portion thereof in the right-and-left direction is bent to extend obliquely to the lower inside and the outside portion thereof in the right-and-left direction is bent to extend obliquely to the lower outside. The width in the right-and-left direction between the outside ends of the respective lift arms 82*a*, 82*b* is set to be broader than the width in the right-and-left direction between the right and left side structures 41R and 41L of the trash withdrawing station 40 (in other words, it is set to be substantially equal to the width in the right-and-left direction of the frame 22 of the first beach cleaner 2). When the second beach cleaner 50 gets into the gap between the right and left side structures 41R and 41L, the respective lift arms 82*a*, 82*b* get on the right and left side structures 41R and 41L, whereby the second beach cleaner 50 is lifted up by a predetermined amount.

Figure 8:
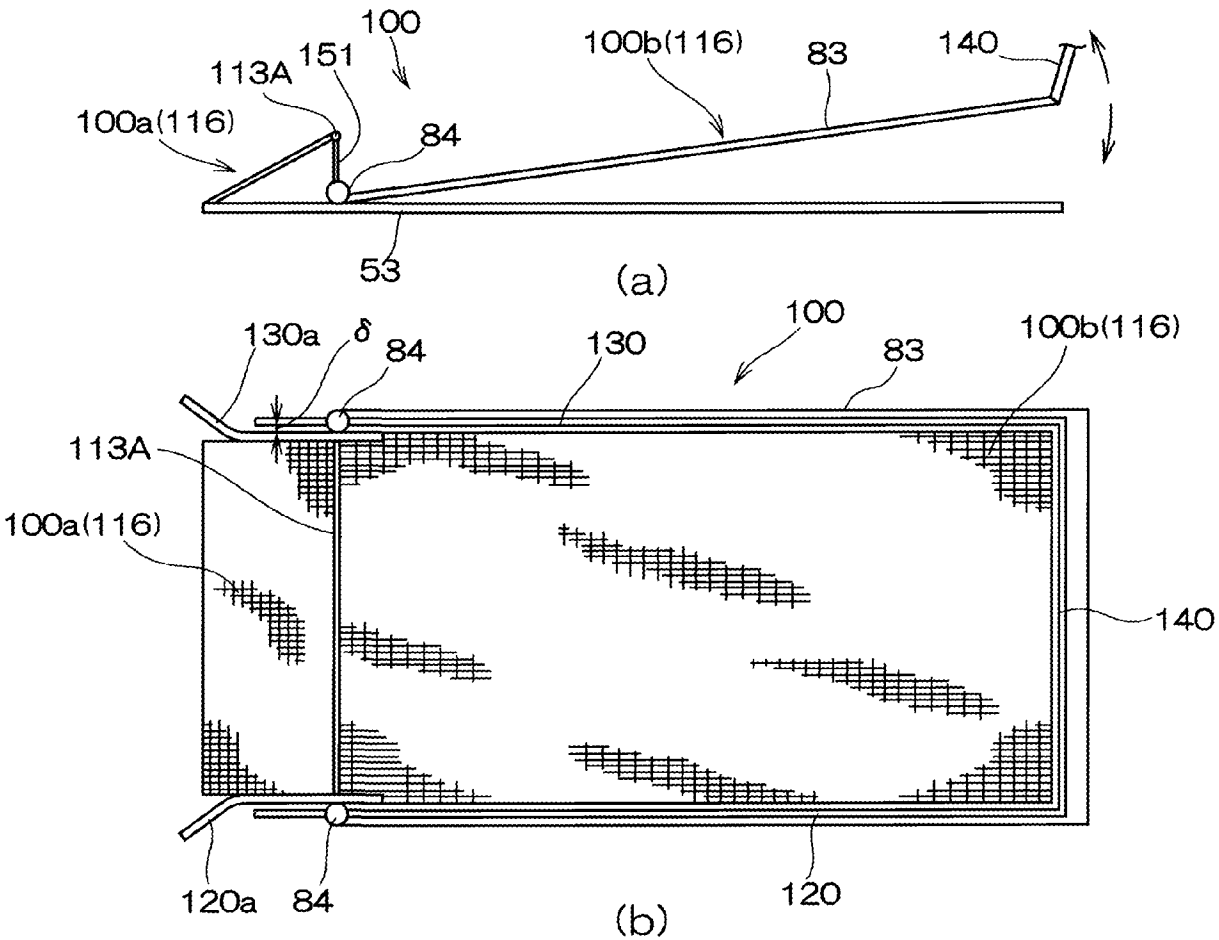
[FIG. 8] is a diagram showing the construction of a trash withdrawing member.

FIG. 8 is a diagram showing the construction of the trash withdrawing member 100.

The trash withdrawing member 100 capable of separating sand and trash from each other is disposed at the rear portion of the frame 53.

The trash withdrawing member 100 is configured in a box shape as a whole so as to be opened to the front and upper sides thereof, and it is formed by securing a woven metallic wire having a predetermined mesh size or a plate to a frame-shaped frame which is mainly formed of steel pipes, for example.

A shown in FIGS. 4, 8*a* and 8*b*, the trash withdrawing member 100 has a fixed withdrawing body 100*a* which is located at the front end portion side to be higher by one step as compared with the rear portion, and a swing withdrawing body 100*b* which is continuous with the rear portion of the fixed withdrawing body 100*a* and swings at the front end thereof at a lower position than the fixed withdrawing body 100*a*.

As shown in FIGS. 8*a* and 8*b*, the fixed withdrawing body 100*a* at the front end portion side is fixed to the frame 53, and located at the front end portion side of the trash withdrawing member 100 so as to project upwardly in a substantially triangular shape. The fixed withdrawing body 100*a* has a vertical pendent portion 151 at the rear surface portion thereof. As shown in FIG. 5, the fixed withdrawing body 100*a* has plural longitudinal frames 111 extending along the vehicle travel direction, and lateral frames 112, 113, 113A which are substantially perpendicular to the longitudinal frames 111 and extend along the width direction (right-and-left direction). A mesh member 116 such as a woven metallic wire or the like is secured on these frames, and fixing side walls (front end side wall portions) 120*a* and 130 which are slightly obliquely upwardly sloped so as to extend more outwards from both the side edges of the mesh member 116 as the position thereof is higher. The fixing side walls 120*a*, 130*a* are fixed to the frame 53 so as to extend along the frame 53, and the front edge thereof is configured to be broader laterally so that trash scraped up by each keel 54 and the scraper 55 can be collected onto the mesh member 116.

The front end of the swing withdrawing body 100*b* at the rear end portion side is supported through a hinge 84 to the base of the pendant portion 151 of the fixed withdrawing body 100*a*, and is swingable at a lower position than the apex portion of the fixed withdrawing body 100*a*. More specifically, as shown in FIG. 4, the swing withdrawing body 100*b* is held by a pair of right and left sub frames 83. The pair of right and left sub frames 83 are arranged along the right and left longitudinal members 51, and bent in side view. The front end portions 83*a* of the sub frames 83 are tilted slightly forwards and downwards, and the rear end portions 83*b* thereof are formed substantially horizontally. Frame brackets 83*d* are secured to the horizontal portions of the longitudinal members 51 located in front of the swing withdrawing body 100*b*. The front end portion 83*a* of the sub frame 83 is supported on the frame bracket 83*d* through a turning shaft (front end) 83*e* along the right-and-left direction. Accordingly, the sub frame 83 is vertically swingable with the turning shaft 83*e* as a fulcrum point, and the swing withdrawing body 100*b* held on the sub frames 83 can be vertically swung.

A pair of hinge brackets 85 constituting a part of the hinge 84 for supporting the left side portion of the swing withdrawing body 100*b* so that the swing withdrawing body 100*b* is turnable are provided in the front-and-rear direction. A hinge pipe 86 is disposed in connection with the hinge bracket 85 at the left side of the swing withdrawing body 100*b*, and the hinge pipe 86 is supported through a hinge shaft 87 extending along the front-and-rear direction by the hinge bracket 85 so as to be freely turnable. The hinge pipe 86 and the hinge shaft 87 are provided on the same axis.

A mooring hook 88 (see FIG. 7) for regulating the turning of the trash withdrawing member 100 is secured to the sub frame 83 at the right side. The mooring hook 88 is formed by folding a metal plate in conformity with the shape of the sub frame 83 and fixing one end of the metal plate to a metal plate main body by a bolt. The other end of the mooring hook 88 is folded so as to be moored to the frame of the swing withdrawing body 100*b* (a joint frame 135 described later).

When the second beach cleaner 50 is lifted up in the trash withdrawing station 40, the swing withdrawing body 100*b* at the rear portion of the frame 53 ascends to a predetermined height. At this time, the mooring hook 88 is detached from the frame of the swing withdrawing body 100*b*, and the swing withdrawing body 100*b* is turned through the hinge 84 at the left side thereof, whereby the work of withdrawing trash collected in the trash withdrawing member 100 can be easily performed. At this time, the trailer 13 is adjacent to the left side of the trash withdrawing station 40, and thus the trash concerned can be directly thrown into the loading portion 16 of the trailer 13.

As shown in FIGS. 4, 5 and 7, the trash withdrawing member 100 has a bottom wall portion (bottom plate) 110 which has a laterally elongated rectangular shape in top view, right and left side wall portions (side walls) 120 and 130 which are slightly obliquely erected from both the side edges of the bottom wall portion 110 so as to extend more outwardly in the right-and-left direction toward the upper side thereof, and a rear wall portion (rear wall) 140 which is sloped from the rear edge of the bottom wall portion 110 to the lower front side.

The right and left side wall portions 120, 130 and the rear wall portion 140 are fixed to the sub frames 83, and the vertically swingable integrally with the sub frames 83.

The right and left side wall portions 120 and 130 and the rear wall portion 140 constitute a surrounding portion 101 which surrounds the periphery of the bottom wall portion 110 while only the front side of the bottom wall portion 110 is opened so that trash scraped up by each keel 54 and the scraper 55 can be collected on the bottom wall portion 110.

As shown in FIG. 8, the right and left side wall portions 120, 130 extend in parallel to the longitudinal direction, and disposed at the outside of the fixing side walls 120*a*, 130*a* to be spaced from the fixing side walls 120*a* and 130*a* through gaps δ.

As shown in FIG. 5, as in the case of the fixed withdrawing body 100*a*, the bottom wall portion 110 is constructed by securing a mesh member 116 such as a woven metallic wire or the like onto plural (for example, nine) longitudinal frames 111 extending along the vehicle running direction and lateral frames 112 to 115 extending along the width direction (the right-and-left direction) which is substantially perpendicular to the longitudinal frames 111. The bottom wall portion 110 is formed along the substantially horizontally extending longitudinal members 51 and substantially horizontally between the lateral frames 114 and 115.

The left side wall portion 120 has a front frame 121 which slopes from the front end portion of the longitudinal frame 111 to the lower front side, a rear frame 122 which slopes from the rear end portion of the longitudinal frame 111 to the lower front side, and joint frames 123 to 124 through which the front frame 121 and the rear frame 122 are joined to each other in the front-and-rear direction, and it is designed in a substantially parallelogram shape. The rear frame 122 is formed to be lower than the front frame 121, and the sloping angle thereof is set to 45°, for example. Side plates 126*a* and 126*b* which cover the left side wall 120 are secured inside the front frame 121, the rear frame 122 and the joint frames 123 to 125 in the vehicle width direction.

A pair of hinge plates 89 are provided at the front and rear portions of the left side wall portion 120 in the front-and-rear direction so as to bridge the longitudinal frame 111 and the joint frame 125. Each hinge plate 89 is designed in a plate-like shape so as to be substantially square-shaped in side view, and it is subjected to a thickness-reducing treatment so that the outer edge portion and the diagonal line portion thereof are left and the edge portions thereof in the front-and-rear direction are bent inwardly in the right-and-left direction to form a reinforcing flange. A hinge pipe 86 is integrally jointed to the outer surface of each hinge plate 89.

The right side wall portion 130 is designed as if the upper front portion of the left side wall portion 120 is gouged, and as shown in FIG. 6, it has front frames 131*a*, 131*b* sloping to the lower front side, a rear frame 132 sloping from the rear end portion of the longitudinal frame 111 to the lower front side, joint frames 133 and 134 through which the front frame 131*a* and the rear frame 132 are joined to each other, and a joint frame 135 through which the front frame 131*b* and the rear frame 132 are joined to each other in the front-and-rear direction. A reinforcing frame 136 which is vertically bent to constitute a reinforcing rib is provided between the longitudinal frame 111 and the joint frame 135.

Side plates 137*a* and 137*b* covering the right side wall 130 are secured at the front and rear sides at the inside of the front frames 131*a*, 131*b*, the rear frame 132, the joint frames 133 to 135 and the reinforcing frame 136 in the vehicle width direction. A handle 138 projecting upwardly is provided in front of the joint portion of the joint frame 135 to the front frame 131*a*. The handle 138 is designed in a U-shape so as to be opened downwardly in side view. The upper side portion of the handle 138 is designed to extend along the front-and-rear direction, and sloped so as to protrude more outwardly than the right side wall portion 130.

As shown in FIG. 4 and FIG. 7, the rear wall portion 140 is provided so as to slope to the lower front side, for example, at 45°, and it has a joint member 141 through which the right and left joint frames 123 and 133 are joined to each other in the right-and-left direction, and a joint frame 142 through which the right and left rear frames 122 and 132 are joined to each other in the right-and-left direction. The joint frame 141 is formed substantially at the same height as the right and left joint frames 123 and 133. The joint frame 142 is formed substantially at the same height as the right and left rear frames 122 and 132. A reinforcing frame 143 which is bent vertically to form a reinforcing rib is provided between the joint frames 141 and 142. A reinforcing frame 144 which is bent vertically to form a reinforcing rib is also provided between the lateral frame 115 and the joint frame 142.

A rear plate 145 covering the upper portion of the rear wall portion 140 is secured to the outsides of the joint frames 141, 142 and the reinforcing frame 143 in the vehicle width direction. Furthermore, a mesh member 146 such as a woven metallic wire or the like for preventing dropping of trash thrown in the trash withdrawing member 100 is provided inside the lateral frame 115, the joint frame 142 and the reinforcing frame 144. The joint frame 142 is provided with an upwardly projecting handle 147. The handle 147 is designed in a U-shape so as to be opened downwardly in rear view, and it is provided to slope so that the upper side portion thereof extends along the right-and-left direction and also protrudes slightly more outwardly than the rear wall portion 140.

As described above, the rear wall portion 140 is provided so as to slope to the lower front side, and the mesh member 146 is disposed on the rear wall portion 140, whereby trash and sand which are scraped up by the keels 54 and the scraper 55 can be received by the rear wall portion 140 and also made to slip down along the mesh-like slant surface. Therefore, the trash and the sand can be separated from each other, so that the burden imposed on a worker can be reduced. Furthermore, the slope angle of the rear wall portion 140 is set to about 45°, whereby trash and sand can be most effectively separated from each other.

The construction that the rear wall portion 140 is provided so as to slope to the lower front side is not limited to the application to this embodiment. For example, it may be applied to a beach cleaner having ski members in place of the wheels 80, for example.

The left side wall portion 120 of the swing withdrawing body 100*b* is joined to and supported by the sub frame 83 at the left side through the hinge 84 so as to be freely turnable as described above, and the mooring hook 88 is hooked to the joint frame 35, whereby the turning of the left side wall portion 120 is suppressed. The mooring hook 88 is detached from the joint frame 135 of the swing withdrawing body 100*b*, the swing withdrawing body 100*b* is turned through the hinge 84 so as to lift the right side of the swing withdrawing body 100*b* upwardly, and the bottom wall portion 110 thereof is set to an erection state that it stands substantially vertically, whereby trash collected in the swing withdrawing body 100*b* falls onto the left side wall portion 120 and the trash concerned is discharged to the outside of the swing withdrawing body 100*b* along the left side wall portion 120.

At this time, by providing the handle 138 to the right side portion 130 of the swing withdrawing body 100*b*, the work of turning the swing withdrawing body 100*b* to collect trash can be facilitated. Furthermore, the hinge 84 is disposed at one short side (left side) of the laterally elongated swing withdrawing body 100*b*, thereby securing the length from the turning shaft (hinge shaft 87) to the operating portion (the handle 138 at the right side) when the swing withdrawing body 100*b* is erected, so that the turning operation of the swing withdrawing body 100*b* can be easily performed.

The side plates 126*a* and 126*b* are mounted on the left side wall portion 120 of the swing withdrawing body 100*b*, whereby the trash concerned can be excellently discharged. The upper edge portion of the left side wall portion 120 of the swing withdrawing body 100*b* is set to protrude more leftward than the left side structure 41L of the trash withdrawing station 40 under the erection state, and the left side wall portion 120 is sloped to directly throw the trash collected in the swing withdrawing body 100*b* to the loading portion 16 of the trailer 13 adjacent to the left side of the trash withdrawing station 40.

The swing withdrawing body 100*b* is supported on the vertically swingable sub frame 83, and thus it is configured to be vertically swingable with the turning shaft 83*e* of the sub frame 83 as a support point. The state that the swing withdrawing body 100*b* is under non-turning state, the swing withdrawing body 100*b* does not ascend, and the bottom wall portion 110 (for example, the lateral frames 112, 114 and 115) thereof comes into contact with the longitudinal members 51 will be hereunder referred to as a stationary state of the swing withdrawing body 100*b*.

Figure 9:
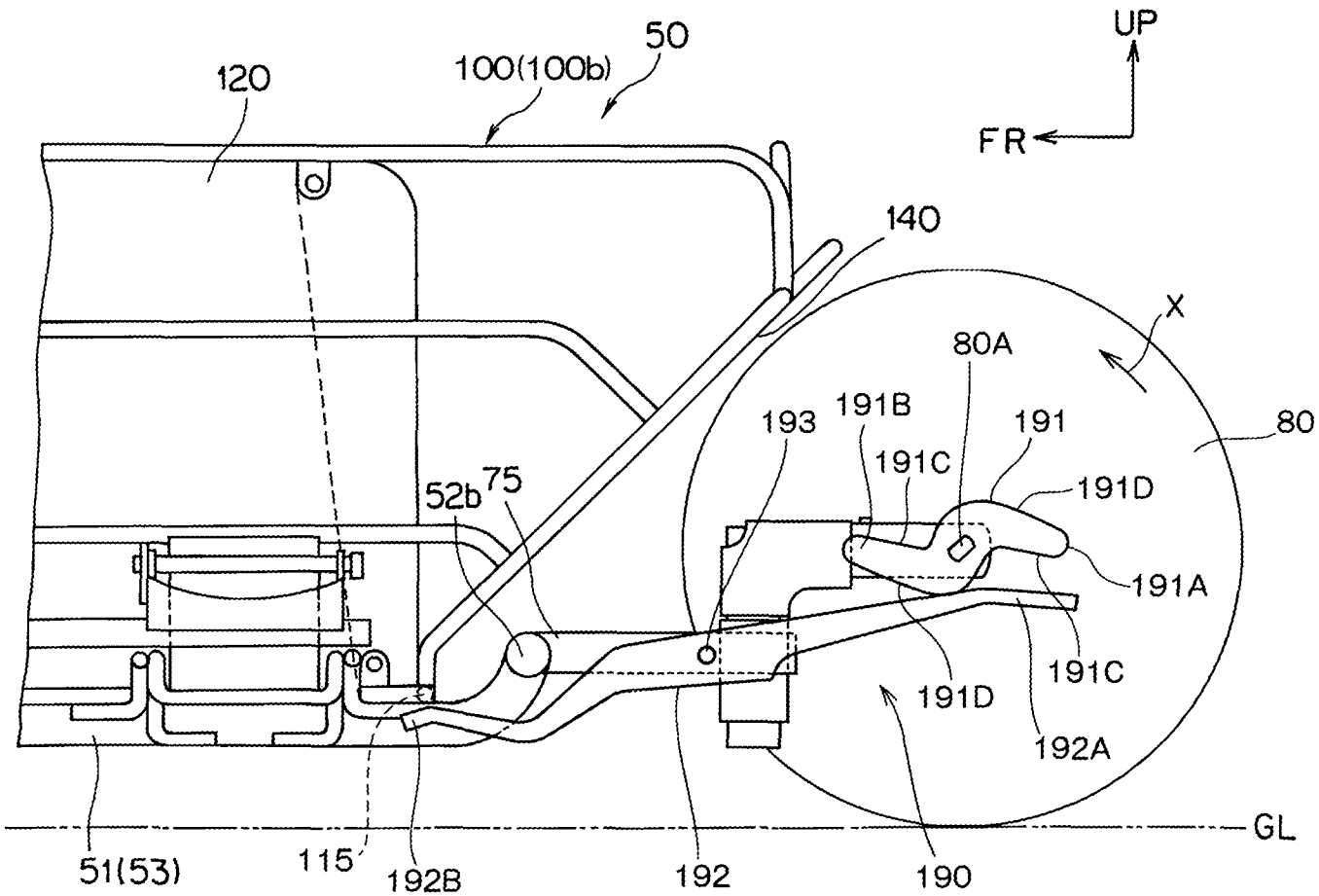
[FIG. 9] is a left side view showing a rear portion of the second beach cleaner.
Figure 10:
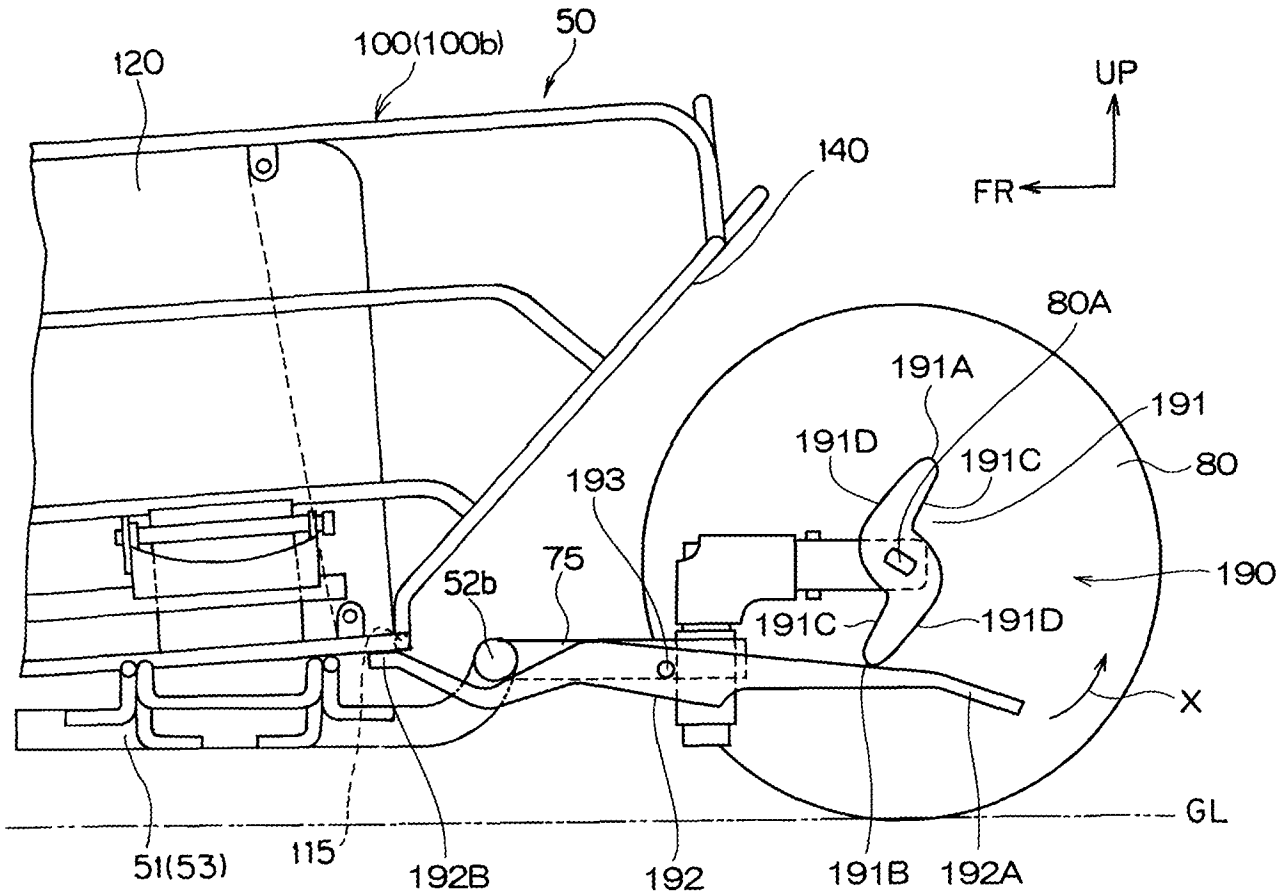
[FIG. 10] is a left side view showing a rear portion of the second beach cleaner.

FIGS. 9 and 10 are left side views showing the rear portion of the second beach cleaner 50.

As shown in FIGS. 5 and 9, a pair of right and left driving force conversion/transmission mechanisms 190 for converting the rotational driving force of the wheels 80 to vibration force and transmitting this vibration to the swing withdrawing body 100*b* is provided at the rear side of the swing withdrawing body 100*b*. Each driving force conversion/transmission mechanism 190 is configured by directly fixing a cam plate 191 to the wheel shaft 80*a* of the wheel 80. The cam plate 191 has cam mountain portions 191A and 191B, and rotates in the direction of an arrow X integrally with the wheel 80. The cam plate 191 has the cam mountain portions 191A and 191B as apexes thereof. The rear edge portion 191 of each of the apexes are configured to be greatly bound up and the front edge portion 191D thereof has a smooth arcuate shape.

The cam lever 192 comes into contact with the cam plate 191. With respect to the cam lever 192, the center portion thereof is freely swingably supported on the extension frame 75 through a support shaft 193 (see FIG. 5), one end 192A thereof comes into contact with the lower surface portion of the cam plate 191, and the other end 192B thereof extends to the front portion of the second beach cleaner 50 at the lower side of the rear lateral member 52*b*, so that the other end 192B extends to the lower side of the lateral frame 115 (or the sub frame 83) of the swing withdrawing body 100*b*.

The cam lever 192 is configured so that the weight of the other end 192B side is larger than the weight of the one end 192A side, and thus urged so as to be turned around the support shaft 193 in the rotational direction of the wheel 80, so that the one end 192A comes into contact with the downwards-facing surface portion of the cam plate 191 at all times.

In FIG. 9, the other end 192B of the cam lever 192 is separated to the lower side of the lateral frame 115 of the trash withdrawing member 100. When the wheel 80 rotates in the direction of the arrow X, the cam plate 191 rotates in the same direction integrally with the wheel 80, and the one end 192A of the cam lever 192 is gradually pushed down according to the smooth cam profile of the front edge portion 191D.

Accordingly, as shown in FIG. 10, the cam lever 192 turns in the opposite direction to the wheel 80 around the supporting shaft 193, and the other end 192B of the cam lever 192 pushes up the lateral frame 115 (or the sub frame 83) of the swing withdrawing body 100*b*.

When the cam protruding portion 191B of the cam plate 191 faces just downwardly, the other end 192B of the cam lever 192 pushes the lateral frame 115 of the swing withdrawing body 100*b* to the highest position.

When the wheel 80 further rotates, the cam protruding portion 191B of the cam plate 191 is separated from the one end 192A of the cam lever 192, and at this time the cam lever 192 loses the support of the cam plate 191 and thus it is drastically displaced from the position of FIG. 10 to the position of FIG. 9 because the rear edge portion 191C of the cam plate 191 has a greatly constricted shape. That is, the other end 192B of the cam lever 192 drastically drops bang, and thus the swing withdrawing body 100*b* drops to the substantially horizontal position.

According to this construction, the operation of pushing up the swing withdrawing body 100*b* and drastically dropping the trash withdrawing member 100 to the substantially horizontal position is repeated twice during one rotation of the wheel 80.

Figure 11:
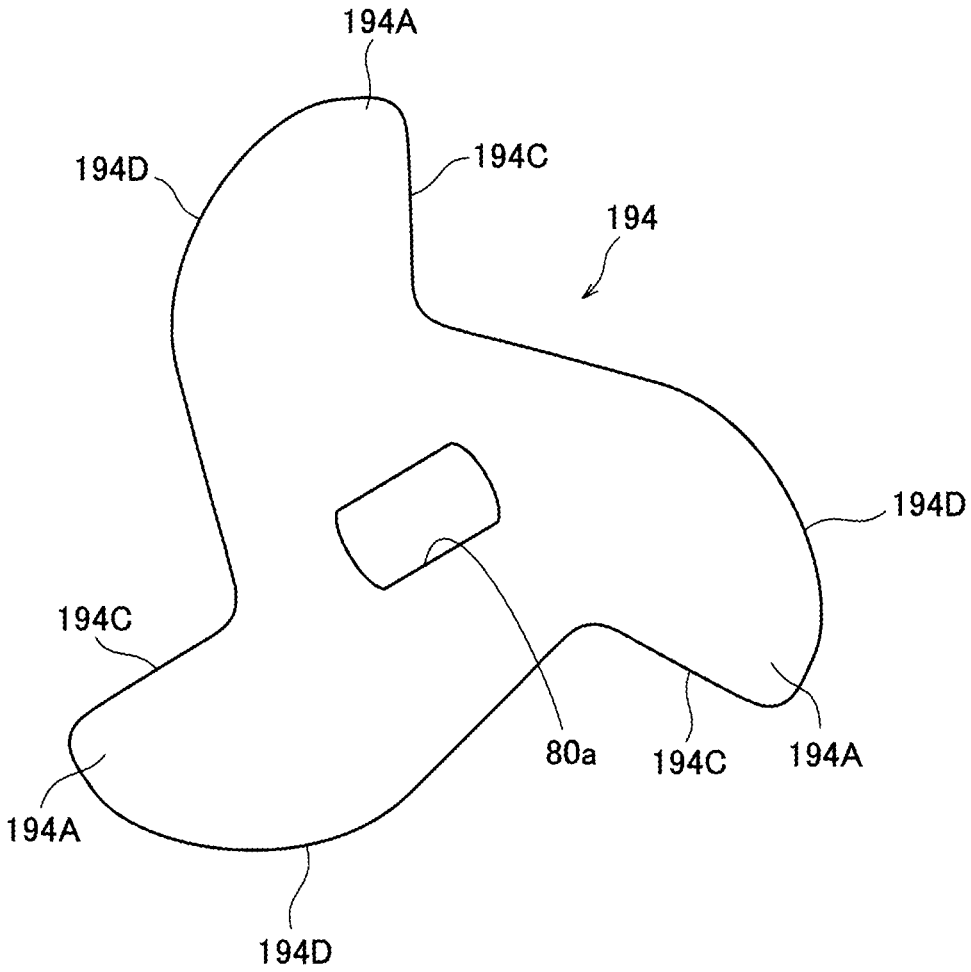
[FIG. 11] is a diagram showing another embodiment of a cam plate.
Figure 13:
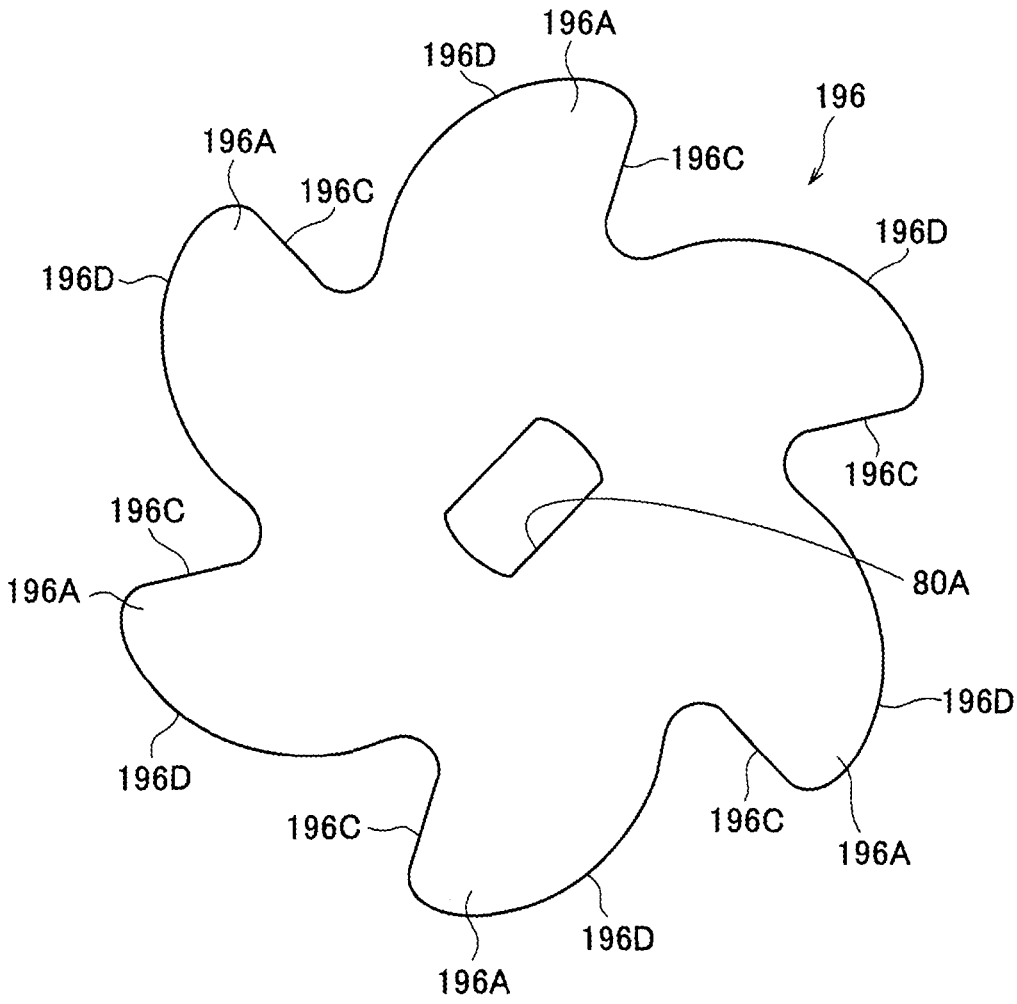
[FIG. 13] is a diagram showing another embodiment of the cam plate.

FIG. 11 and FIG. 13 shows other embodiments of the cam plate.

Figure 12:
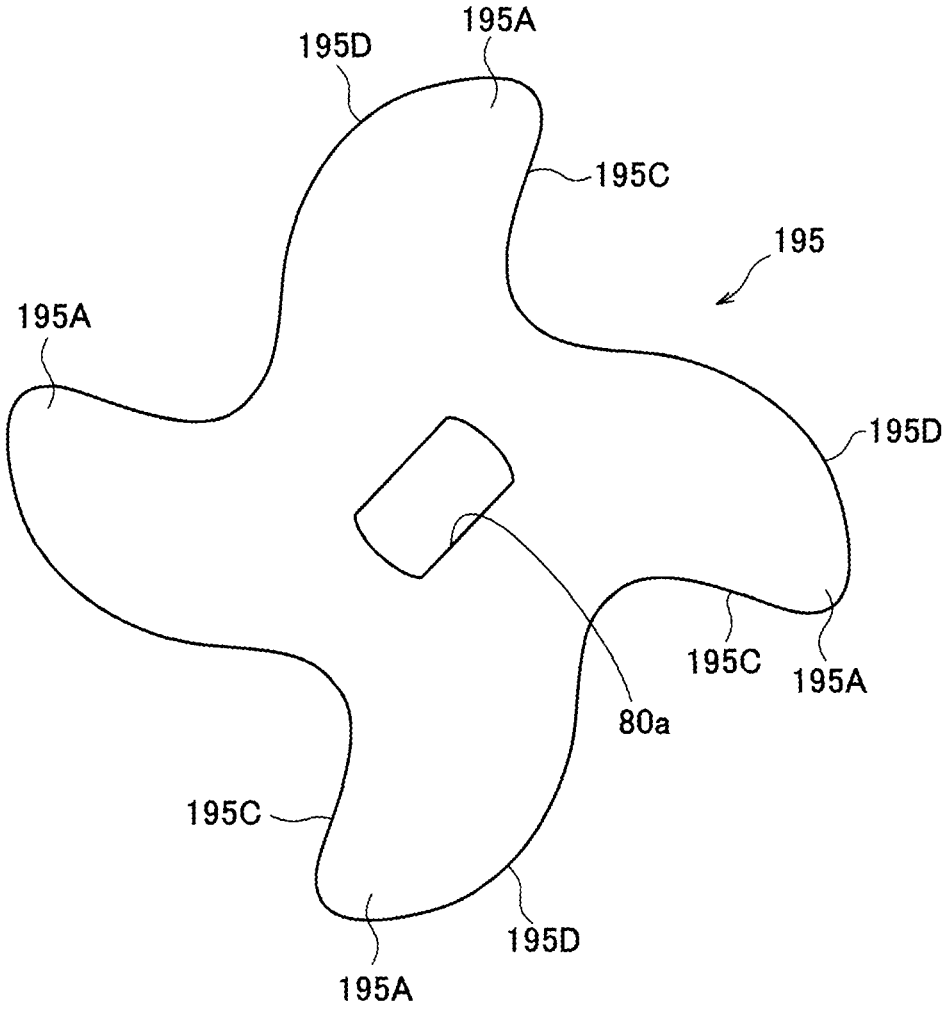
[FIG. 12] is a diagram showing another embodiment of the cam plate.

A cam plate 194 shown in FIG. 11 has three cam protruding portions 194A, a cam plate 195 shown in FIG. 12 has four cam protruding portions 195A, and a cam plate 196 shown in FIG. 13 has six cam protruding portions 196A.

All the cam plates 194 to 196 have greatly constricted rear edge portions 194C to 196C, and front edge portions 194D to 196D having smooth arcuate shapes.

With respect to the cam plate 194 of FIG. 11, the swing withdrawing body 100*b* drastically drops bang three times during one rotation of the wheel 80. With respect to the cam plate 195 shown in FIG. 12, the trash withdrawing member 100 drastically drops four times, and with respect to the cam plate 196 shown in FIG. 13, the trash withdrawing member 100 drastically drops bang six times. When the dropping frequency is large, sand can be more efficiently screened out, however, the behavior of sand on the mesh member 116 is unstable. Accordingly, the cam plate is arbitrarily selected in accordance with the condition of the beach.

The ascending amount of the rear portion of the swing withdrawing body 100*b* can be changed by changing the projection amount of the cam mountain portion 191B. That is, when the projection amount of the cam mountain portion 191B is increased, the ascending amount of the swing withdrawing body 100*b* increases. On the other hand, when the projection amount of the cam mountain portion 191B is reduced, the ascending amount of the swing withdrawing body 100*b* decreases.

Next, the utilization procedure of each of the beach cleaners 20 and 50 will be described.

First, each of the beach cleaners 20, 50 and the trash withdrawing station 40 is loaded onto the trailer 13 and transported to a predetermined cleaning work place (sand beach) as shown in FIG. 1.

Here, the respective beach cleaners 20, 50 are loaded on the trailer 13 while integrally assembled with each other. However, the trash withdrawing station 40 is loaded on the trailer while divided into the right and left front and rear divided parts 41*a*, 41*b*, the right intermediate divided part 41*d*, the front and rear joint members 42 and each foot member 45.

More specifically, the pair of front and rear divided parts 41*a* and 41*b* (or the pair of front or rear divided parts) are first loaded on the trailer 13 (mounted in the loading portion 16), and then each of the beach cleaners 20, 50 is loaded onto the trailer 13. At this time, the first beach cleaner 20 is loaded while both side portions of the front and rear lateral members 24*a*, 24*b* of the frame 22 thereof are loaded on the right and left side portions 16*b* and 16*c* of the loading portion 16 (the upper side portions 44*c* of the guide members 44 of the trash withdrawing station 40), and the sand pins 23 at both the sides of the rearmost column come into contact with the outer surfaces of the wheel houses 16*a* from the front side, whereby the rearward movement of the first beach cleaner 20 is regulated.

Furthermore, the second beach cleaner 50 is loaded while the longitudinal members 51 of the frame 53 thereof are put on the front and rear lateral members 24*a*, 24*b* of the loaded first beach cleaner 20 and tilted slightly downwards and rearwards, and the respective keels 54 come into contact with the front lateral members 24*a* of the first beach cleaner 20 from the front side, whereby the rearward movement of the second beach cleaner 50 is regulated.

In the trash withdrawing station 40, the other pair of front and rear divided parts 41*a*, 41*b* (or a pair of front or rear divided parts) and the right intermediate divided part 41*d* are loaded to be overlapped with the upper sides of the front slope portions 57 and the scraper frames 58 of the loaded second beach cleaner 50. Each joint member 42 is loaded at the right side of the loading portion 16 while tilted forwards and downwards, for example, and each foot member 45 is mounted at the left side of the rear portion of the loading portion 16, for example.

The loading state of the trash withdrawing station 40 is not limited to the state described above. Only the right intermediate divided part 41*d* may be loaded on the upper side of each front slope portion 57 and the scraper frame 58 of the loaded second beach cleaner 50, the pair of the front and rear divided parts 41*a*, 41*b* may be loaded so as to be aligned along the right and left direction at the rear side of the second beach cleaner 50, and the other pair of front and rear divided parts 41*a*, 41*b* may be loaded in the loading portion 16. At this time, the respective foot members 45 are mounted while suitably sorted to the right and left sides of the rear portion of the loading portion 16.

When arriving at the predetermined cleaning work place (sand beach), each of the beach cleaners 20, 50 being loaded is unloaded onto the ground. At this time, the rear divided parts 41*b* are joined to the right and left side portions 16*b*, 16*c* of the loading portion 16 of the trailer 13 to set the unloading work state, and each of the loaded beach cleaners 20, 50 is unloaded along to the right and left guide members 44 onto the ground, whereby even when each of the beach cleaners is integrally assembled, each beach cleaner 20, 50 can be relatively easily unloaded onto the ground, and also the trash withdrawing work can be quickly performed.

Subsequently, the installation work of the trash withdrawing station 40 is executed at a predetermined position on the sand beach. First, one of the rear divided parts 41*b* is detached from the left side portion 16*b* of the loading portion 16 of the trailer 13 under the unloading work state, and the rear divided part 41*b*, the right intermediate divided part 41*d* and the front divided part 41*a* are joined to one another to construct the right side portion structure 41R. Furthermore, the front divided part 41*a* is joined to the right side portion 16*c* of the loading portion 16 of the trailer 13 to construct the left side portion structure 41L.

The right and left side portion structures 41R and 41L are joined to each other through the front and rear joint members 42, and each foot member 45 is secured to a predetermined place, whereby the trash withdrawing station 40 is assembled under the installation state. At this time, the relatively large-scale trash withdrawing station 40 is loaded on the loading portion 16 while divided into the plural divided parts, etc., and thus the work of unloading the trash withdrawing station 40 from the trailer 13 can be easily performed.

Subsequently, the first beach cleaner 20 is trailed by the vehicle 1 to make the first beach cleaner 20 run on the sand beach at a fixed speed, whereby relatively large trash on the sand beach is withdrawn. The first beach cleaner 20 withdraws relatively large trash on the sand beach while each sand pin 23 bits into the sand. Therefore, the running resistance is relatively large, and the running speed is set to a low speed of about 5 to 10 km/h.

When the first beach cleaner 20 runs on the sand beach and a predetermined amount of trash is collected below the frame 22 thereof as described above, the first beach cleaner 20 temporarily returns to the trash withdrawing station 40, and the withdrawing work of the collected trash is performed. At this time, when the vehicle 1 passes between the right and left side portion structures 41R and 41L of the trash withdrawing station 40 and then the first beach cleaner 20 goes into the gap between the right and left side portion structures 41R and 41L, the right and left side portions of the frame 22 run upon the right and left side portion structures 41R and 41L, and the first beach cleaner 20 is lifted up by a predetermined amount (see FIG. 3). The vehicle 1 and the first beach cleaner 20 are stopped and the withdrawing work of the trash dropped onto the sand is performed under the state that the first beach cleaner 20 runs upon the upper side portions 44*c* of the guide members 44 of the right and left side portion structures 41R and 41L, and then the vehicle 1 and the first beach cleaner 20 are made to run again to repeat the trash withdrawing work described above.

After a predetermined range is cleaned by the first beach cleaner 20, the second beach cleaner 50 is next trailed to run in the same range to withdraw relatively small trash on the sand beach. As described above, the keels 54, the scrapers 55, the trash withdrawing body 100, etc. for minute trash can be suppressed from being damaged by using the second beach cleaner 50 after the first beach cleaner 20. The running speed of the second beach cleaner 50 is set to about 15 to 25 km/h which is slightly higher than that of the first beach cleaner 20 because the sand beach is dug up and becomes soft and also it is necessary to scrape up the sand and trash by the respective keels 54 and the scrapers 55.

When the second beach cleaner 50 runs on the sand beach, relatively small trash is scraped up by the respective keels 54 and the scrapers 55 together with the sand, and they are collected in the trash withdrawing member 100 at the rear portion of the frame 53. At this time, when the trash and the sand scraped up by the keels 54 and the scrapers 55 impinge against the rear wall portion 140 which is tilted frontwards and downwards, they slip down on the mesh member 146 and the sand is screened out from the mesh member 146. Accordingly, the trash and the sand can be separated from each other, so that the load imposed on the worker can be reduced.

The swing withdrawing body 100*b* is vertically swung by the driving force conversion/transmission mechanism 90 while the second beach cleaner 50 runs. Accordingly, the sand collected in the swing withdrawing body 100*b* is screened out from the swing withdrawing body 100*b* by this vertical swing motion, so that the sand can be suppressed from being stocked in the swing withdrawing body 100*b*.

When the second beach cleaner 50 runs on the sand beach and a predetermined amount of trash is collected in the trash withdrawing member 100 as described above, the second beach cleaner 50 is temporarily returned to the trash withdrawing station 40, and the work of withdrawing the collected trash is performed.

At this time, when the vehicle 1 passes between the right and left side portion structures 41R and 41L of the trash withdrawing station 40 and then the second beach cleaner 50 goes into the gap between the right and left side portion structures 41R and 41L, the right and left lift arms 82*a* and 82*b* at the front and rear sides thereof run upon the right and left side portion structures 41R and 41L, and the second beach cleaner 50 is lifted up by a predetermined amount. After the vehicle 1 and the second beach cleaner 50 are stopped and the work of withdrawing collected trash is performed by turning the swing withdrawing body 100*b* laterally under the state that the second beach cleaner 50 runs upon the upper side portions 44*c* of the guide members 44 of the right and left side portion structures 41R and 41L, the vehicle 1 and the second beach cleaner 50 are made to run again so that the trash withdrawing work described above is repeated.

When the swing withdrawing body 100*b* is turned to perform the withdrawing work of the collected trash, the trash is directly thrown onto the loading portion 16 of the trailer 13 adjacent to the left side of the trash withdrawing station 40. Therefore, the loading portion 16 can be used as a trash withdrawing container, and the withdrawn trash can be transported by the trailer 13 after the cleaning work is finished. In addition, it is unnecessary to perform a work of withdrawing trash dropped onto the ground, and the number of steps of the cleaning work can be reduced.

As described above, according to this embodiment, the driving force conversion/transmission mechanism 90 for converting the rotational driving force of the wheels 80 to the vibration force to vibrate the swing withdrawing body 100*b* is provided. Therefore, the vibration is applied to the swing withdrawing body 100*b* in connection with the rotation of the wheels 80, and thus sand invading onto the mesh member 116 can be screened out and prevented from being stocked, so that the load of the worker which is required for treatment of sand can be reduced.

At this time, the driving force conversion/transmission mechanism 190 converts the driving force of the wheels 80 to the driving force for vertically vibrating the swing withdrawing body 100*b* through the cam plate 191 and the cam lever 192, and transmitting the driving force. Therefore, the rotational driving force of the wheels can be remarkably efficiently converted to the vibration by a simple mechanism unlike a mechanism using a chain or the like, for example. Furthermore, the swing withdrawing body 100*b* is dropped to a substantially horizontal position over plural times with a bang. Therefore, the sand can be efficiently screened out by the impact at that time.

The swing withdrawing body 100*b* is freely swingably supported by the frame 53 through the hinge 84 located at the fixed withdrawing body 100*a* side, and the lowermost portion of the swing withdrawing body 100*b* is fixed to the fixed withdrawing body 100*a* side. Therefore, trash such as pebbles or the like is effectively captured at the step portion formed between the swing withdrawing body 100*b* and the fixed withdrawing body 100*a*. Furthermore, the swinging width of the neighborhood of the hinge 84 is small, and thus dropout of pebbles or the like due to popping caused by the swing can be prevented.

In the construction described above, the swing withdrawing body 100*b* is vertically vibrated, and thus there is a high possibility that trash such as pebbles or the like put on the mesh member 116 is moved to the front end portion side of the swing withdrawing body 100*b*.

According to this embodiment, the fixed swing body 100*a* is located in front of the swing withdrawing body 100*b* to be higher by one step than the other sites. Therefore, the trash such as the pebbles or the like which move to the front end portion of the swing withdrawing body 100*b* is intercepted by the pendent portion 151 which is higher by one step in a substantially triangular shape, and thus does not drop to the front end portion side of the trash withdrawing member 100.

Furthermore, according to this embodiment, the sub frames 83 which are swingable at the rear portions thereof with the turning shafts 83*e* as a supporting point are secured to the pair of right and left longitudinal members 51, and the swing withdrawing body 100*b* is secured to the sub frames 83. Accordingly, the swing withdrawing body 100*b* is vibrated with the turning shafts 83*e* of the sub frames 83 as a supporting point. Therefore, sand invading onto the mesh member 116 can be screened out, so that the load on the worker can be reduced.

According to this embodiment, the side wall portions of both the sides of the trash withdrawing member 100 are formed to be divided into the fixed side walls (front end side wall portions) 120*a* and 130*a* at the fixed withdrawing body 100*a* side and the right and left side wall portions 120 and 130 (the rear end side wall portions) at the swing withdrawing body 100*b* side, one side is the fixed structure while the other side is the swing structure and the side walls at the boundary of these structures are divided side walls, so that the side walls can be provided to each structure. Furthermore, the front end edges of the fixed side walls 120*a* and 130 are formed to spreads frontwards, so that trash scraped up by the respective keels 54 and the scrapers 55 can be easily collected. Still furthermore, the right and left side wall portions 120 and 130 are arranged to be overlapped with the outside of the rear end edges of the fixed side walls 120*a* and 130*a*. Therefore, the side walls of the respective structures are overlapped with each other at the boundary portion to establish a double fitting structure, so that sand is hard to invade into the fitting portion.

According to the above embodiment, one of the right and left sides of the swing withdrawing body 100*b* is joined to the sub frame 83 while the other side is joined to the sub frame through the detachable mooring hook 88, and the swing withdrawing body 100*b* is rotatable laterally with the hinge 84 as a supporting point. Accordingly, when trash is withdrawn, the mooring hook 88 is detached and the swing withdrawing body 100*b* is laterally turned over to withdraw trash. Therefore, the trash can be easily withdrawn.

Furthermore, according to the above embodiment, the swing withdrawing body 100*b* has the right and left side wall portions 120, 130, the bottom wall portion 110 and the rear wall portion 140, the bottom wall portion 110 and the rear wall portion 140 are formed in a mesh-like shape, and the rear wall portion 140 is provided to be tilted rearwards. Therefore, trash and sand scraped up by the keels 54 and the scrapers 55 are received by the rear wall portion 140, and can be slipped downwards along the mesh-like slope surface. Therefore, the trash and the sand can be separated from each other, so that the load of the worker can be reduced.

Figure 14:
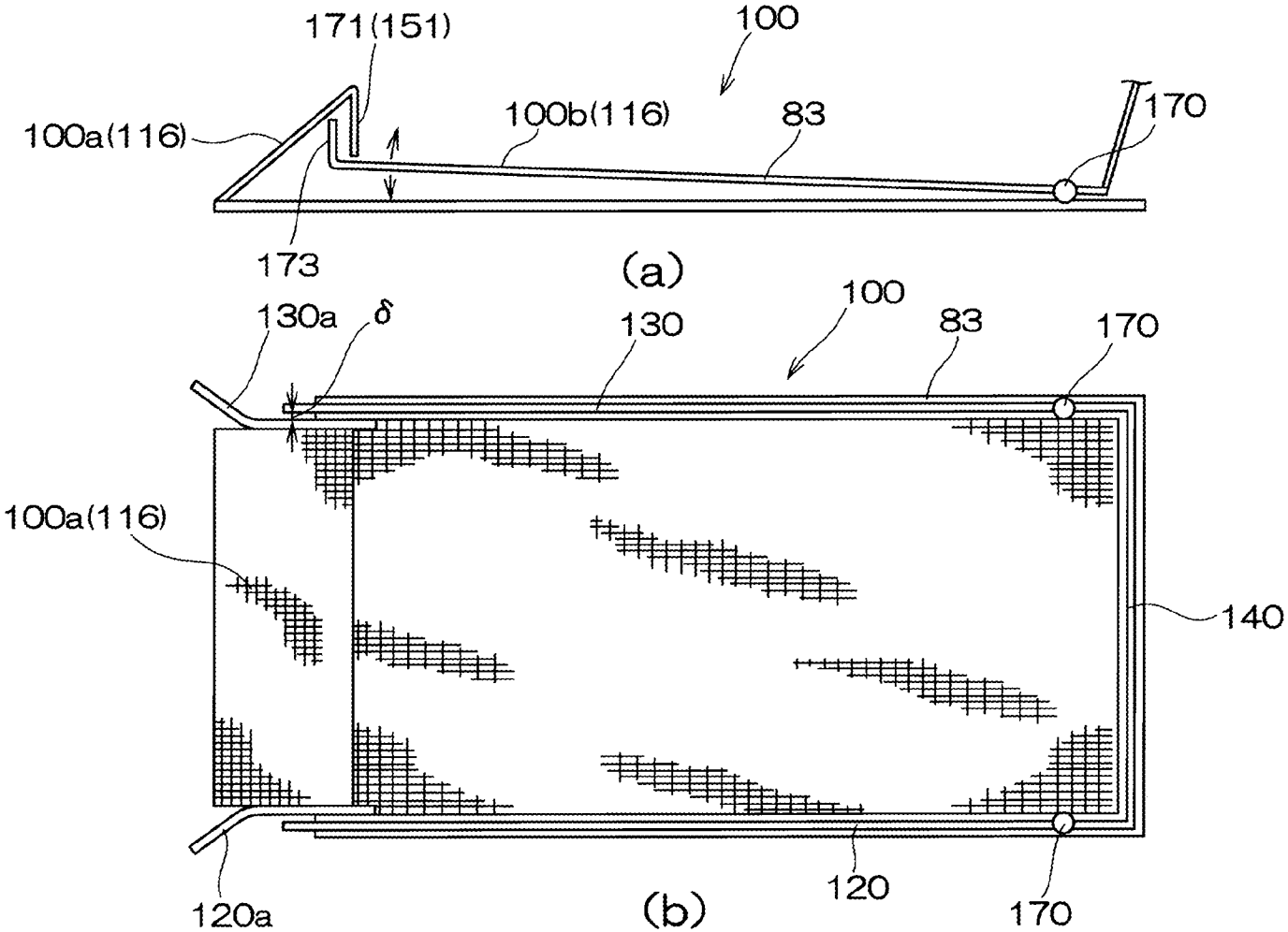
[FIG. 14] is a diagram showing another embodiment which corresponds to FIG. 8.

FIG. 14 shows another embodiment.

This figure is a corresponding figure to FIG. 8, and this embodiment is different from the above embodiment in the position of a hinge 170 of the swing withdrawing body 100*b*. That is, the swing withdrawing body 100*b* is freely swingably supported on the frame 53 through the hinge (support shaft) 170 which is located at a rear side of the center portion in the front and rear direction. The rear end edge 171 of the fixed withdrawing body 100*a* (the pendent portion 151) downwardly hangs, and the front end edge of the swing withdrawing body 100*b* is put into the inside of the rear end edge 171 of the fixed withdrawing body 100*a* and upwardly folded back to thereby form a fold-back portion 173. As not shown, the combination of the cam plate 191 and the cam lever 192 shown in FIG. 9 or the like may be adopted as the swing withdrawing body 100*b*, and the other end 192B of the cam lever 192 may be brought into contact with the extension portion 175 extending to the rear side of the hinge 170 from the upper side.

According to this embodiment, the swing withdrawing body 100*b* is freely swingably supported on the frame 53 through the hinge 170 located at the rear side of the center portion in the front and rear direction. Therefore, the front end portion of the swing withdrawing body 100*b* is greatly swung, so that pebbles or the like gather together at a rear end portion having a small swing width and hardly move to the front end portion of the swing withdrawing body 100*b*. Therefore, dropout of pebbles or the like can be prevented.

Furthermore, the rear end edge 171 of the fixed withdrawing body 100*a* hangs downwardly, and the front end edge of the swing withdrawing body 100*b* is located inside the rear end edge 171 and folded back upwardly to form the fold-back portion 173. Therefore, the step portion formed between the swing withdrawing body 100*b* and the fixed withdrawing body 100*a* is kept and the engaging structure is established, whereby the dropout of pebbles or the like to the front side can be prevented, and sandy beads invading into the engaging portion can be pulverized by the engagement.

When the front end edge of the swing withdrawing body 100*b* is vibrated, the tip of the fold-back portion 173 impinges against the back surface of the fixed withdrawing body 100*a* every time the front end edge is vibrated, and thus the vibration caused by the impact is applied to the swing withdrawing body 100*b*, so that the screening effect of sand can be enhanced.

In this case, the tip of the rear end edge 171 of the fixed withdrawing body 100*a* may be made to impinge against the upper surface of the swing withdrawing body 100*b* on a case-by-case basis. This also applies the vibration based on impact to the swing withdrawing body 100*b*, so that the sand screening effect can be enhanced.

The above embodiment is an example of the present invention, and it is needless to say that various modifications may be suitably made without departing from the subject matter of the present invention.

For example, in the above embodiment, the right and left cam plates 191 are secured while the two cam mountain portions 191*a* and 191B are positionally conformed between the right and left cam plates 191, and the cam mountain portions 191A and 191B are rotated in synchronism with each other. However, the positions of the right and left cam mountain portions 191A and 191B may be changed so that the right and left sides of the swing withdrawing body 100*b* are vertically swung separately from each other.

Furthermore, in the above embodiment, the pair of right and left wheels 80 are provided, however, two or more pairs of wheels may be provided. In this case, plural wheels may be disposed at the outside in the wheel width direction of the front ski plate 74 to stabilize the rear portion of the second beach cleaner 50. Furthermore, only one wheel may be provided at the center CL in the right and left direction. In this case, driving force converting/transmitting means whose number corresponds to the number of wheels may be provided. In the above embodiment, the other end 192B of the cam lever 192 is brought into contact with the lateral frame of the swing withdrawing body 100*b*, however, the other end 192B of the cam lever 192 may be brought into contact with the sub frame 83.

Description Of Reference Numerals

1 vehicle (trailing vehicle)
50 second beach cleaner (beach cleaner)
53 frame
54 keel (separator)
55 scraper (separator)
83 sub frame
83*a* turning shaft (front end)
84 hinge
88 mooring hook
100 trash withdrawing member
100*a* fixed withdrawing body
100*b* swing withdrawing body
110 bottom wall portion (bottom plate)
120 left side wall portion (side wall)
130 right side wall portion (side wall)
120*a*, 130*a* fixing side wall
140 rear wall portion (rear wall)
190 driving force conversion/transmission mechanism
191, 194, 195, 196 cam plate
191A, 191B cam mountain portion
GL ground surface (sand surface)

The invention claimed is:

1. A beach cleaner, comprising:

a frame including a longitudinal member and a lateral member, a ski member secured to a front portion of the frame and grounded to a sand surface, a trailing target portion capable of being towed by a vehicle, a separator provided at a front lower portion of the frame and capable of scraping up trash from a sand area while separating the trash from sand, a trash withdrawing member provided to the frame at a rear side of the separator to collect the trash scraped up by the separator onto a mesh member, and a wheel at a rear side of the frame, wherein the trash withdrawing member comprises a fixed withdrawing body that is located at a front end portion and fixed to the frame so as to be higher than the frame, and a swing withdrawing body that is continuous with a rear portion of the fixed withdrawing body and is supported so that a front end thereof is swingable at a lower position than the fixed withdrawing body, to separate trash and sand from each other, wherein the trash withdrawing member has a box shape and is opened to the front and upper sides thereof, wherein the fixed withdrawing body includes a vertical pendent portion at the rear surface portion thereof, and wherein the front end of the swing withdrawing body is supported through a hinge to the pendent portion of the fixed withdrawing body.

2. The beach cleaner according to claim 1, wherein the swing withdrawing body is freely swingably supported on the frame through a support shaft located at a side of said swing withdrawing body which is closest to said fixed withdrawing body.

3. The beach cleaner according to claim 1, wherein the swing withdrawing body is freely swingably supported on the frame through a support shaft located at a rear side of a center portion in a front and rear direction.

4. The beach cleaner according to claim 3, wherein a rear end edge of the fixed withdrawing body hangs downwardly, and wherein a front end edge of the swing withdrawing body is located forward of the rear end edge and is folded upwardly to form a fold-back portion.

5. The beach cleaner according to claim 1, wherein the swing withdrawing body is held by a sub frame, and the sub frame is freely swingably supported on the frame through a support shaft.

6. The beach cleaner according to claim 1, wherein said fixed withdrawing body of said trash withdrawing member includes front end side wall portions, and wherein said swing withdrawing body of said trash withdrawing member includes rear end side wall portions.

7. The beach cleaner according to claim 6, wherein the front end edges of the front end side wall portions of said fixed withdrawing body spread outwards and frontwards, and wherein the rear end side wall portions of said swing withdrawing body overlap with outsides of the rear end edges of the front end side wall portions of said fixed withdrawing body.

* * * * *